US009977354B2

(12) United States Patent
Ida et al.

(10) Patent No.: US 9,977,354 B2
(45) Date of Patent: May 22, 2018

(54) COATING LIQUID FOR ELECTROPHOTOGRAPHIC PHOTORECEPTOR PRODUCTION, ELECTROPHOTOGRAPHIC PHOTORECEPTOR, AND IMAGE FORMATION APPARATUS

(71) Applicant: MITSUBISHI CHEMICAL CORPORATION, Chiyoda-ku (JP)

(72) Inventors: Kazutaka Ida, Kanagawa (JP); Akiteru Fujii, Kanagawa (JP)

(73) Assignee: MITSUBISHI CHEMICAL CORPORATION, Chiyoda-ku (JP)

( * ) Notice: Subject to any disclaimer, the term of this patent is extended or adjusted under 35 U.S.C. 154(b) by 0 days. days.

(21) Appl. No.: 15/376,941

(22) Filed: Dec. 13, 2016

(65) Prior Publication Data

US 2017/0090308 A1 Mar. 30, 2017

Related U.S. Application Data

(63) Continuation of application No. PCT/JP2015/067088, filed on Jun. 12, 2015.

(30) Foreign Application Priority Data

Jun. 13, 2014 (JP) ..... 2014-122519

(51) Int. Cl.

| | |
|---|---|
| ***G03G 5/00*** | (2006.01) |
| ***G03G 5/047*** | (2006.01) |
| ***G03G 5/05*** | (2006.01) |
| ***G03G 5/06*** | (2006.01) |

(52) U.S. Cl.
CPC ..... *G03G 5/047* (2013.01); *G03G 5/0507* (2013.01); *G03G 5/0612* (2013.01)

(58) Field of Classification Search
CPC ..... G03G 5/047; G03G 5/0507; G03G 5/0612
USPC ..... 430/58.8
See application file for complete search history.

(56) References Cited

U.S. PATENT DOCUMENTS

| | | | | |
|---|---|---|---|---|
| 4,931,350 | A | 6/1990 | Shimada et al. | |
| 2002/0076633 | A1 | 6/2002 | Niimi | |
| 2010/0183332 | A1 | 7/2010 | Zhao et al. | |
| 2010/0216065 | A1 | 8/2010 | Kurachi et al. | |
| 2013/0052574 | A1* | 2/2013 | Fujii | G03G 15/75 430/56 |

FOREIGN PATENT DOCUMENTS

| | | | |
|---|---|---|---|
| JP | 63-178243 | A | 7/1988 |
| JP | 9-160268 | A | 6/1997 |

(Continued)

OTHER PUBLICATIONS

International Search Report dated Jul. 7, 2015 in PCT/JP2015/067088 (with English language translation).

*Primary Examiner* — Mark A Chapman
(74) *Attorney, Agent, or Firm* — Oblon, McClelland, Maier & Neustadt, L.L.P.

(57) ABSTRACT

Provided is a lamination-type electrophotographic photoreceptor comprising a conductive substrate, and a charge transport layer and a charge generation layer both on the conductive substrate, wherein the charge transport layer comprises a charge transport substance represented by the general formula (1), a binder resin, and a particulate silicon compound.

19 Claims, 2 Drawing Sheets

(56) References Cited

FOREIGN PATENT DOCUMENTS

| | | | |
|---|---|---|---|
| JP | 10-339962 | A | 12/1998 |
| JP | 2001-343763 | A | 12/2001 |
| JP | 2002-169312 | A | 6/2002 |
| JP | 2002-182409 | A | 6/2002 |
| JP | 2002-328483 | A | 11/2002 |
| JP | 2005-289877 | A | 10/2005 |
| JP | 2006-301498 | A | 11/2006 |
| JP | 2007-72487 | A | 3/2007 |
| JP | 2007-108239 | A | 4/2007 |
| JP | 2007-108314 | A | 4/2007 |
| JP | 2007-314808 | A | 12/2007 |
| JP | 2008-96520 | A | 4/2008 |
| JP | 2008-176051 | A | 7/2008 |
| JP | 2010-185964 | A | 8/2010 |
| JP | 2010-224529 | A | 10/2010 |
| JP | 2011-118323 | A | 6/2011 |
| JP | 2013-101379 | A | 5/2013 |
| JP | 2014-95868 | A | 5/2014 |

* cited by examiner

COATING LIQUID FOR ELECTROPHOTOGRAPHIC PHOTORECEPTOR PRODUCTION, ELECTROPHOTOGRAPHIC PHOTORECEPTOR, AND IMAGE FORMATION APPARATUS

TECHNICAL FIELD

The present invention relates to at least a coating liquid for electrophotographic photoreceptor production. More specifically, it relates to a coating liquid for electrophotographic photoreceptor production, for the purpose of producing an electrophotographic photoreceptor having good mechanical properties such as abrasion resistance and good image properties such as filming and also having good electrical properties including repetition under normal temperature and normal humidity and under high temperature and high humidity.

BACKGROUND ART

For recent electrophotographic photoreceptors, durability is more required than before in view of both electrical properties and mechanical properties. Of these, in view of mechanical properties, in order to cope with long-term use, it is one problem to improve abrasion resistance of the outermost surface of the photoreceptors. As technologies for solving the problem on the abrasion resistance, there have been disclosed a technology of forming a surface layer on the outer surface of the photosensitive layer (Patent Documents 1 and 2), a technology of adding an inorganic compound to the photosensitive layer (Patent Documents 3 and 4), use of a novel photosensitive layer (Patent Documents 5 and 6), and the like.

Of these, the addition of an inorganic compound is the most easily applicable technology but the effect is not exhibited unless a certain degree of amount of the compound is added. On the other hand, when it is added in a large amount, it becomes a problem to maintain a dispersion state of inorganic particles in a coating liquid for the photosensitive layer mainly composed of organic compounds.

In the case where the dispersion state of the inorganic particles is not homogeneous, aggregation of the inorganic particles occurs on the surface of the coating liquid for the photosensitive layer to cause image defects such as density unevenness and colored spots. As a mean for solving such a problem on particle dispersion stability, there is known a method of incorporating an additive, for example, a dispersing agent such as a polyester resin or an acrylic resin (Patent Document 7).

On the other hand, a charge transport layer of a lamination-type electrophotographic photoreceptor or a photosensitive layer of a monolayer-type photoreceptor in which the inorganic particles are incorporated contains a charge transport substance and a binder resin as main components. For selecting a charge transport substance to be used, it is necessary to know an information that what kind of a series of process designs of charging, exposure, discharging, and the like are performed in an objective copier or printer, as a basic information and, based on the information, the charge transport substance is selected in consideration of properties derived from the molecule or electrical characteristic knowledge such as charge transporting ability or residual potential of the charge transport substance.

In recent years, charge transport substances having a triphenylamine structure have been frequently used. Of these, monotriphenylamine derivatives are simple in the synthetic route and are relatively easy to obtain raw materials thereof and easy to perform molecular modification, so that many compounds have been proposed and used (Patent Documents 8 and 9).

PRIOR ART DOCUMENTS

Patent Documents

Patent Document 1: JP-A-2011-118323
Patent Document 2: JP-A-2010-224529
Patent Document 3: JP-A-10-339962
Patent Document 4: JP-A-2008-176051
Patent Document 5: JP-A-2007-314808
Patent Document 6: JP-A-2013-101379
Patent Document 7: JP-A-2007-72487
Patent Document 8: JP-A-63-178243
Patent Document 9: JP-A-2005-289877

SUMMARY OF THE INVENTION

Problems that the Invention is to Solve

As mentioned above, in the case of a coating liquid for electrophotographic photoreceptor production in which a binder resin and inorganic particles are co-present in an organic solvent, since the inorganic particles are prone to aggregate, dispersion stabilization is one problem. According to studies done by the present inventors, particularly for a particulate silicon compound, it is difficult to reduce aggregation in the coating liquid.

For production sites that aim at an improvement in yields and an improvement in quality, in the case where a coating liquid exhibiting poor dispersion stability is used, it is necessary to use the coating liquid after homogenization and a homogenization operation of the coating liquid and confirmation of homogenization influence the productivity in photoreceptor production. The technique of dispersing inorganic particles using a dispersing agent described in Patent Document 7 is simple and convenient and has less influence on the productivity but has such a problem that the electrical properties of the photoreceptor get worse.

Namely, an object of the present invention is to provide a coating liquid for electrophotographic photoreceptor production, which is excellent in dispersion stability without any additional operation such as re-dispersion even when a particulate silicon compound is contained in a large amount. Moreover, another object is to provide an electrophotographic photoreceptor which has a uniform film and does not have any image defects such as density unevenness and colored spots.

Means for Solving the Problems

As a result of intensive studies for solving the above problems, the present inventors have found that, by incorporating a charge transport substance having a specific structure, a binder resin, and a particulate silicon compound, the resulting coating liquid for electrophotographic photoreceptor production is excellent in dispersion stability without involving any additional operations such as re-dispersion even when the liquid contains a large amount of the particulate silicon compound. Thus, they have completed the present invention.

That is, the gist of the invention lies in the following <1> to <18>.

<1> A lamination-type electrophotographic photoreceptor comprising a conductive substrate, and a charge transport layer and a charge generation layer both on the conductive substrate, wherein the charge transport layer comprises a charge transport substance represented by the general formula (1), a binder resin, and a particulate silicon compound:

[Chem 1]

General Formula (1)

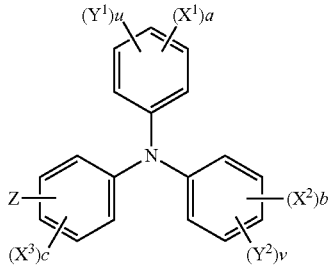

wherein $X^1$ to $X^3$ each independently represent an alkyl group, an alkoxy group, an aryl group, or an aryloxy group and a to c each independently represent 0 to 5; $Y^1$ and $Y^2$ each independently represents an alkenyl structure represented by the following general formula (A) and u and v each independently represents 0 to 3; z represents an alkenyl structure represented by the following general formula (B):

[Chem 2]

General Formula (A)

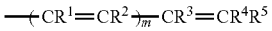

wherein $R^1$ to $R^4$ each independently represent a hydrogen atom, an alkyl group, or an aryl group, $R^5$ represents an aryl group, and m represents 0 to 3;

[Chem 3]

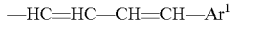

General Formula (B)

wherein $Ar^1$ represents an aryl group.

<2> The electrophotographic photoreceptor according to the <1>, wherein the particulate silicon compound is subjected to a surface treatment with a reactive organosilicon compound.

<3> The electrophotographic photoreceptor according to the <1> or <2>, wherein the content of the particulate silicon compound is 5% by mass or more and 15% by mass or less in the solid content in the charge transport layer.

<4> The electrophotographic photoreceptor according to any one of the <1> to <3>, wherein average primary particle diameter of the particulate silicon compound is 0.01 μm or more and 1.0 μm or less.

<5> The electrophotographic photoreceptor according to any one of the <1> to <4>, which comprises an ether having a boiling point of 90° C. or lower and an ether having a boiling point of 120° C. or higher.

<6> The electrophotographic photoreceptor according to any one of the <1> to <5>, wherein the charge transport substance represented by the above general formula (1) is contained in an amount of 60 parts by mass or less relative to 100 parts by mass of the binder resin in the charge transport layer.

<7> The electrophotographic photoreceptor according to any one of the <1> to <6>, wherein the charge transport layer contains a silicone oil.

<8> The electrophotographic photoreceptor according to any one of the <1> to <7>, wherein, when the photoreceptor is charged so that initial surface potential of the photoreceptor becomes −700 V, and the photoreceptor is irradiated with a monochrome light of 780 nm to irradiate it with the exposure light at an intensity of 1.0 $\mu J/cm^2$, an absolute value of surface potential of the photoreceptor after 100 ms is 53 V or less.

<9> The electrophotographic photoreceptor according to any one of the <1> to <8>, wherein, in the above general formula (1), a=1, b=0, c=0, v=1, and u=0, $Y^2$ and Z are substituted on a para-position starting from the carbon to which a nitrogen atom is bonded; in the above general formula (A), m=1, $R^1$ to $R^4$ are each a hydrogen atom, and $R^5$ is an aryl group.

<10> The electrophotographic photoreceptor according to any one of the <1> to <9>, wherein the charge transport substance represented by the above general formula (1) is a charge transport substance represented by the following general formula (2):

[Chem 4]

General Formula (2)

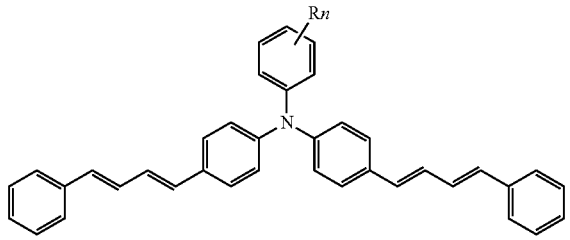

wherein R is an alkyl group or alkoxy group having 8 or less carbon atoms; n represents an integer of 0 to 3; and, when n is 2 or 3, R(s) each independently represent an alkyl group or alkoxy group having 8 or less carbon atoms.

<11> The electrophotographic photoreceptor according to any one of the <1> to <10>, wherein the charge transport substance represented by the above general formula (1) is at least one charge transport substance selected from the group represented by the following general formulae (1A), (1B), (1C), (1D), and (1E):

[Chem 5]

(1A)

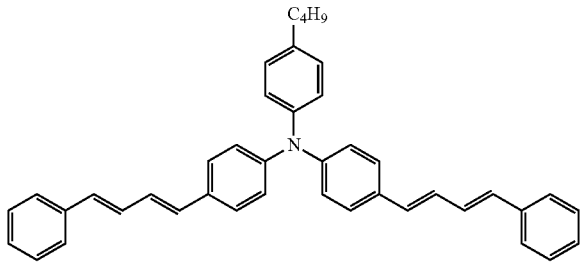

-continued (1B)

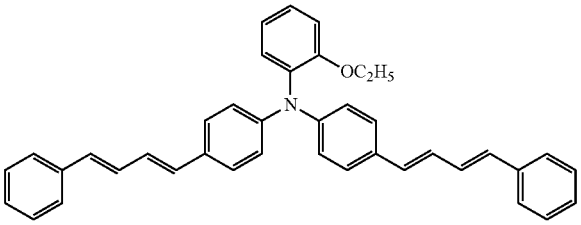

[Chem 6]

(1C)

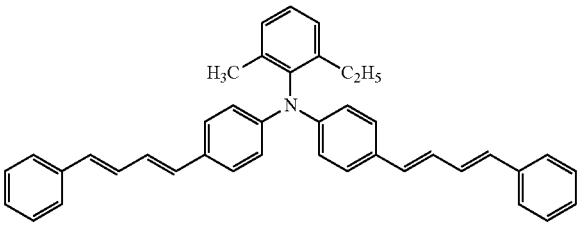

(1D)

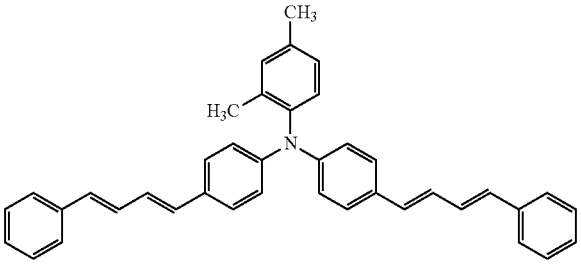

[Chem 7]

(1E)

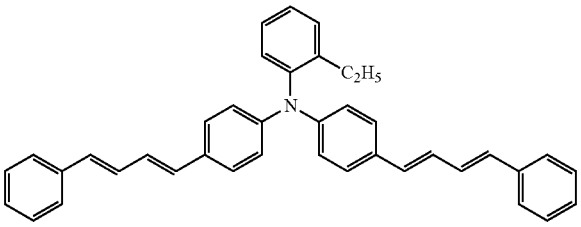

<12> An electrophotographic photoreceptor cartridge comprising: the electrophotographic photoreceptor according to any one of the <1> to <11>; and at least one device selected from the group consisting of a charging device that charges the electrophotographic photoreceptor, an exposing device that exposes the charged electrophotographic photoreceptor to form an electrostatic latent image, and a developing device that develops the electrostatic latent image formed on the electrophotographic photoreceptor.

<13> An image formation apparatus comprising: the electrophotographic photoreceptor according to any one of the <1> to <11>; and at least one device selected from the group consisting of a charging device that charges the electrophotographic photoreceptor, an exposing device that exposes the charged electrophotographic photoreceptor to form an electrostatic latent image, and a developing device that develops the electrostatic latent image formed on the electrophotographic photoreceptor.

<14> A coating liquid for electrophotographic photoreceptor production comprising: a charge transport substance represented by the following general formula (1), a binder resin, and a particulate silicon compound:

[Chem 8]

General Formula (1)

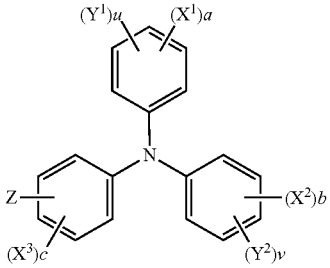

wherein $X^1$ to $X^3$ each independently represent an alkyl group, an alkoxy group, an aryl group, or an aryloxy group and a to c each independently represent 0 to 5; $Y^1$ and $Y^2$ each independently represents an alkenyl structure represented by the following general formula (A) and u and v each independently represents 0 to 3; z represents an alkenyl structure represented by the following general formula (B):

[Chem 9]

General Formula (A)

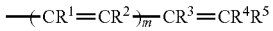

wherein $R^1$ to $R^4$ each independently represent a hydrogen atom, an alkyl group, or an aryl group, $R^5$ represents an aryl group, and m represents 0 to 3;

[Chem 10]

General Formula (B)

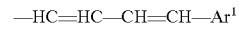

wherein $Ar^1$ represents an aryl group.

<15> The coating liquid for electrophotographic photoreceptor production according to the <14>, which comprises an ether having a boiling point of 90° C. or lower and an ether having a boiling point of 120° C. or higher.

<16> The coating liquid for electrophotographic photoreceptor production according to the <14> or <15>, wherein, upon microscopic observation of a surface of a coated film obtained by applying the coating liquid on a conductive substrate so that the film thickness becomes 18 μm, the average number of massive materials of 4 μm or more observed in eight viewing fields each having a size of 60 μm×80 μM is 10 or less.

<17> The coating liquid for electrophotographic photoreceptor production according to any one of the <14> to <16>, wherein the charge transport substance represented by the above general formula (1) is a charge transport substance represented by the following general formula (2):

[Chem 11]

General Formula (2)

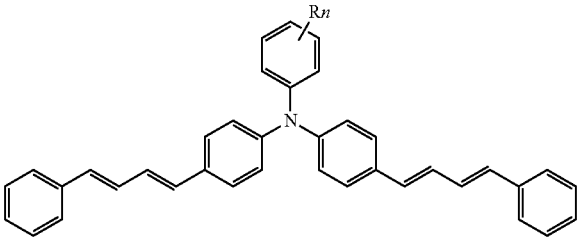

wherein R is an alkyl group or alkoxy group having 8 or less carbon atoms; n represents an integer of 0 to 3; and, when n is 2 or 3, R(s) each independently represent an alkyl group or alkoxy group having 8 or less carbon atoms.

<18> A coating liquid for electrophotographic photoreceptor production comprising at least a charge transport substance, a binder resin, and a particulate silicon compound, wherein, after storage on still standing for 10 days from the day when the coating liquid is produced, either of transmittance of a light having a wavelength of 780 nm through the coating liquid at a position of three fourth the liquid height in the storage vessel of the coating liquid and transmittance of the light through the coating liquid at the bottom of the storage vessel of the coating liquid is 85% or more, and a difference between them falls within 10%.

Advantage of the Invention

According to the present invention, there is provided a coating liquid for electrophotographic photoreceptor production having good dispersion stability of a particulate silicon compound in the coating liquid and having good stability of the coating liquid. Moreover, there is obtained an electrophotographic photoreceptor excellent in electrical properties including repetition under normal temperature and normal humidity and under high temperature and high humidity and capable of filming suppression and image defect suppression by using the coating liquid.

MODES FOR CARRYING OUT THE INVENTION

Figure 1:
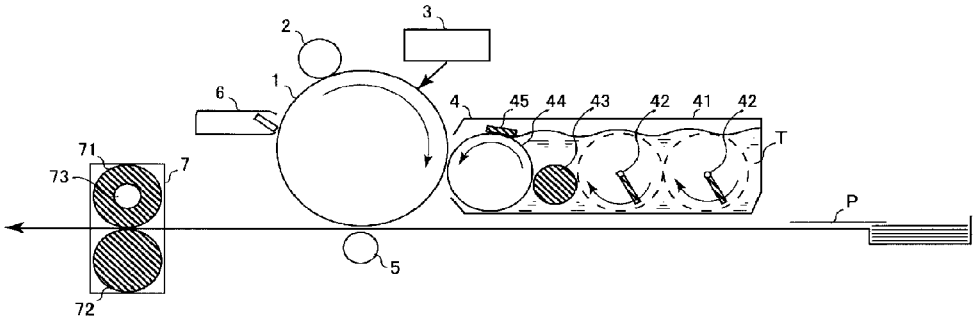
FIG. 1 is a schematic view illustrating an example of important part configuration of the image formation apparatus of the invention.

Modes for carrying out the invention are explained below in detail. However, the following explanations on constituent elements are representative examples of embodiments of the invention, and the embodiments can be suitably modified unless the modifications depart from the gist of the invention.

<<Electrophotographic Photoreceptor>>

The configuration of the electrophotographic photoreceptor of the invention is described below. With regard to the electrophotographic photoreceptor of the invention, the configuration thereof is not particularly limited as long as it has a photosensitive layer comprising a charge transport substance represented by the above general formula (1), a binder resin, and a particulate silicon compound on a conductive support (on an undercoat layer in the case of providing an undercoat layer).

In the case where the photosensitive layer of the electrophotographic photoreceptor is a lamination type to be described later, the charge transport substance represented by the above general formula (1), the binder resin, the particulate silicon compound, and, if necessary, an antioxidant, a leveling agent, and other additives are contained in a charge transport layer.

Moreover, in the case where the photosensitive layer of the electrophotographic photoreceptor is a monolayer type to be described later, it is common to use a charge generating material and an electron transport material in addition to the components used in the charge transport layer of the aforementioned lamination-type photoreceptor.

In order to cope with a high-speed machine, it is preferable that, when the photoreceptor is charged so that initial surface potential of the photoreceptor becomes −700 V and the photoreceptor is irradiated with a monochrome light of 780 nm to irradiate it with the exposure light at an intensity of 1.0 $\mu J/cm^2$, an absolute value of surface potential of the photoreceptor after 100 ms is 53 V or less.

Since the particulate silicon compound sometimes inhibits charge migration, even when the particulate silicon compound is contained in the charge transport layer, residual potential can be kept low by making the dispersion state good.

<<Coating Liquid for Electrophotographic Photoreceptor Production>>

The coating liquid for electrophotographic photoreceptor production is a coating liquid for forming each layer mentioned before and is not particularly limited. From the viewpoints of charge transporting ability and mechanical properties, it is preferably a coating liquid for photosensitive layer formation and more preferably a coating liquid for charge transport layer or protective layer formation in the above-described lamination type.

The coating liquid of the invention contains the charge transport substance represented by the above general formula (1), the binder resin, the particulate silicon compound, and other components to be used according to need, and the coating liquid can be manufactured by dissolving or dispersing them in an organic solvent.

The coating liquid is, in the case where it is a coating liquid for electrophotographic photoreceptor production comprising the charge transport substance, the binder resin, and the particulate silicon compound, preferably such that, after storage on still standing for 10 days from the day when the coating liquid is produced, either of transmittance of a light having a wavelength of 780 nm through the coating liquid at a position of three fourth the liquid height in the storage vessel of the coating liquid and transmittance of the light through the coating liquid at the bottom of the storage vessel of the coating liquid is 85% or more and a difference between them falls within 10%. From the viewpoint of homogeniety, the difference is more preferably 1% or less.

The coating liquid satisfying the above transmittance difference is good in dispersion of the particulate silicon compound and is capable of long-term storage. The transmittance difference can be achieved, for example, by using the charge transport substance represented by the above general formula (1).

Moreover, from the viewpoint of prevention of coating unevenness, upon microscopic observation of a surface of a coated film obtained by applying the coating liquid on a conductive substrate so that the film thickness becomes 18 μm, the average number of massive materials of 4 μm or more observed in eight viewing fields each having a size of 60 μm×80 μm is preferably 10 or less and more preferably 5 or less.

<Conductive Support>

The conductive support is not particularly limited. Mainly used as the conductive support is, for example, a metallic material such as aluminum, an aluminum alloy, stainless steel, copper, or nickel, a resin material to which electrical conductivity has been imparted by adding a conductive powder of, e.g., a metal, carbon, or tin oxide, or a resin, glass, paper, or the like, the surface of which has been vapor-deposited or coated with a conductive material such as aluminum, nickel, or ITO (indium oxide/tin oxide). One of these may be used alone, or two or more thereof may be used in any desired combination and any desired ratio.

With respect to the form of the conductive support, the one in the form of a drum, sheet, belt, or the like is used. Furthermore, there may be used a conductive support which is obtained by applying a conductive material having an appropriate resistance value on a conductive support of a metallic material, for the purposes of controlling conductivity, surface properties, etc. or covering defects.

In the case where a metallic material such as an aluminum alloy is used as a conductive support, the material may be used after an anodized coating film is formed thereon. In the case where an anodized coating film has been formed, it is desirable to subject the material to a pore-filling treatment by a known method.

The surface of the support may be smooth, or may have been roughened by using a special cutting method or by performing a roughening treatment. Alternatively, there may be used a support having a roughened surface obtained by mixing particles having an appropriate particle diameter into the material that constitutes the support. Furthermore, a drawn pipe can be used as such without subjecting the pipe to any cutting treatment, for the purpose of cost reduction.

<Undercoat Layer>

In the electrophotographic photoreceptor of the invention, an undercoat layer is not essential but, in the case where the undercoat layer is provide, any undercoat layer may be provided. As the undercoat layer, a binder alone may be used but it is preferable to contain an inorganic filler such as metal oxide particles in view of electrical properties and the like.

As the metal oxide particles, preferred are those exhibiting high dispersion stability in the coating liquid and specifically, for example, there may be mentioned silica, alumina, titanium oxide, barium titanate, zinc oxide, lead oxide, indium oxide, and the like. Of these, metal oxide particles showing n-type semiconductor properties are preferred, zinc oxide and tin oxide are more preferred, and titanium oxide is particularly preferred.

Both of crystalline and amorphous titanium oxide can be used. In the case of crystalline one, the crystal form may be any of anatase form, rutile form, and brookite form but, for the reasons of water absorbability and efficiency of a surface treatment, the anatase form or rutile form is generally used. Particularly preferred is to use the rutile form.

For the reason of dispersion stability in the coating liquid, the average particle diameter of the metal oxide particles is usually preferably 100 nm or less and particularly preferably from 10 to 60 nm. The particle diameter of the particles to be used in the coating liquid may be uniform or may be a mixed system of different particle diameters.

In the case of the mixed system of different particle diameters, it is preferable that the maximum peak of the particle diameters exists around 150 nm and the minimum particle diameter has a particle diameter distribution of from about 30 nm to about 500 nm. For example, particles having an average particle diameter of 0.1 μm and particles having an average particle diameter of 0.03 μm may be mixed and used.

As the binder resin to be contained in the undercoat layer, for example, there may be used a resin material of a poly(vinyl acetal), a polyamide resin, a phenol resin, a polyester, an epoxy resin, a polyurethane, polyacrylamide, or the like. Of these, preferred is a polyamide resin that is excellent in adhesiveness of the support and is less soluble in the solvent to be used for the coating liquid for charge generation layer.

In particular, more preferred is a polyamide usable for an alcohol-based solvent that is excellent in handling. Examples of the polyamide include methoxymethylated Nylon resins such as Tresin F-30K, MF-30, and EF-30T manufactured by Nagase ChemteX Corporation and FINELEX FR-101, FR-104, FR-105, and FR-301 manufactured by Namariichi Co., Ltd.; polymerized fatty acid-based polyamides such as PA-100, PA-100A, PA-102A, PA-105A, PA-200, and PA-201 manufactured by T&K TOKA Corporation; and polymerized fatty acid-based polyamide block copolymers such as TPAE-12 and TPAE-32 manufactured by T&K TOKA Corporation.

The ratio of the metal oxide particles to the binder resin can be arbitrarily selected but, in view of stability, applicability, and electrical properties of the liquid, the ratio is preferably in the range of 0.5 part by mass to 8 parts by mass, and more preferably in the range of 2 parts by mass to 5 parts by mass relative to 1 part by mass of the binder resin.

When the thickness of the undercoat layer is too thin, the effect on local charging defect is not sufficient but, when it is too thick, the layer causes an increase in residual potential or a decrease in adhesive strength between the conductive substrate and the photosensitive layer.

The thickness of the undercoat layer in the electrophotographic photoreceptor of the invention is preferably from 0.1 to 20 μm, more preferably from 2 to 10 μm, and further preferably from 3 to 6 μm. The volume resistivity value of the undercoat layer is usually $1\times10^{11}$ Ω·cm or more, preferably $1\times10^{12}$ Ω·cm or more and usually $1\times10^{14}$ Ω·cm or less, preferably $1\times10^{13}$ Ω·cm or less.

For obtaining a undercoat coating liquid containing the metal oxide particles and the binder resin, it is suitable to mix the binder resin or a solution obtained by dissolving the binder resin in an appropriate solvent into a slurry of the metal oxide particles treated with a pulverization or dispersion treatment apparatus such as a planetary mill, a ball mill, a sand mill, a bead mill, a paint shaker, an attritor, or an ultrasonic wave, followed by a dissolution and stirring treatment. In reverse, it is also suitable to add the metal oxide particles to the binder resin solution and perform a pulverization or dispersion treatment with such a dispersion apparatus as described above.

<Charge Generation Layer>

The charge generation layer is formed by binding a charge generation substance with a binder resin. Concretely, the charge generation layer is formed by dispersing a charge generation substance in a solution, in which a binder resin has been dissolved in an organic solvent, to prepare a coating liquid and applying the liquid onto a conductive support (in the case of providing an undercoat layer, onto the undercoat layer). The thickness of the layer is usually 0.1 μm or more, preferably 0.15 μm or more and usually 10 μM or less, preferably 0.6 μm or less.

When the ratio of the charge generation substance is too high, the stability of the coating liquid may worsen owing to aggregation of the charge generation substance. On the other hand, when the ratio of the charge generation substance is too low, there is a concern that the sensitivity of the photoreceptor would lower.

[Charge Generation Substance]

Examples of the charge generation substance include inorganic photoconductive materials such as selenium and an alloy thereof, and cadmium sulfide; and organic photoconductive materials such as organic pigments. Organic photoconductive materials are more preferred, and organic pigments are particularly preferred.

Examples of the organic pigments include phthalocyanine pigments, azo pigments, dithioketopyrrolopyrrole pigments, squalene (squarylium) pigments, quinacridone pigments, indigo pigments, perylene pigments, polycyclic quinone pigments, anthanthrone pigments, benzimidazole pigments, and the like. Of these, phthalocyanine pigments and azo pigments are especially preferable. In the case where an organic pigment is used as the charge generation substance, in general, it is used as a dispersion layer in which fine particles of the organic pigment are bound with any of various binder resins.

In the case where a metal-free phthalocyanine compound or a metal-containing phthalocyanine compound is used as the charge generation substance, there is obtained a photoreceptor having a high sensitivity to a relatively long wavelength laser beam, for example, a laser beam having a wavelength of around 780 nm. Moreover, in the case where an azo pigment such as monoazo, diazo, or trisazo one is used, there can be obtained a photoreceptor having a sufficient sensitivity to a white light or a laser beam having a wavelength of around 660 nm or a relatively short wavelength laser beam, for example, a laser beam having a wavelength of around 450 nm or 400 nm.

In the case where an organic pigment is used as the charge generation substance, a phthalocyanine pigment or an azo pigment are particularly preferred. The phthalocyanine pigment is excellent in view of obtaining a photoreceptor having a high sensitivity to a relatively long wavelength laser beam and the azo pigment is excellent in view of a sufficient sensitivity to a white light and a relatively short wavelength laser beam.

In the case where a phthalocyanine pigment is used as the charge generation substance, concretely, there is used, for example, a metal-free phthalocyanine or any of various crystal forms of phthalocyanines coordinated with a metal such as copper, indium, gallium, tin, titanium, zinc, vanadium, silicon, germanium or aluminum or with an oxide, a halide, a hydroxide, an alkoxide or the like thereof and phthalocyanine dimers using an oxygen atom or the like as a crosslinking atom.

Particularly preferred are metal-free phthalocyanines of X-form and τ-form that are crystal forms with high sensitivity; titanyl phthalocyanines (also called oxytitanium phthalocyanine) of A-form (also called β-form), B-form (also called α-form), D-form (also called Y-form), and other forms; vanadyl phthalocyanine; chloroindium phthalocyanine; hydroxyindium phthalocyanine; chlorogallium phthalocyanines of II-form and other forms; hydroxygallium phthalocyanines of V-form and other forms; μ-oxo-gallium phthalocyanine dimers of G-form, I-form, and other forms; and μ-oxo-aluminum phthalocyanine dimers of II-form and other forms.

Among these phthalocyanines, more preferred are A-form (also called β-form) and B-form (also called α-form) titanyl phthalocyanines; D-form (Y-form) titanyl phthalocyanine that shows a clear peak at a powder X-ray diffraction angle 2θ (±0.2°) of 27.1°, 27.2°, or 27.3°; II-form chlorogallium phthalocyanine; V-form hydroxygallium phthalocyanine and hydroxygallium phthalocyanine that has the highest peak at 28.1°; hydroxygallium phthalocyanine that does not have a peak at 26.2° but has a clear peak at 28.1° and a half bandwidth W of $1° \leq W \leq 0.4°$ at 25.9°; and G-form μ-oxo-gallium phthalocyanine dimer. From the viewpoint of sensitivity and stability of electrical properties, further preferred is D-form (Y-form) titanyl phthalocyanine that has at least the maximum peak at the Bragg angle (2θ±0.2°) of 27.2° in the CuKα characteristic X-ray diffraction spectrum, does not have a peak at 26.2° and does not have a peak of temperature change from 50° C. to 400° C. other than the peak associated with vaporization of adsorbed water in differential scanning calorimetry.

A single phthalocyanine compound may be used, or a mixture or a mixed crystal of some of the compounds may also be used. As the mixed state in the phthalocyanine compounds or in the crystal state thereof, the individual constituent elements to be used may be mixed later, or the mixed state may be formed in the process of production or treatment of phthalocyanine compounds, for example, in the process of synthesis, pigment formation, or crystallization thereof. As the treatment, there are known an acid paste treatment, a grinding treatment, a solvent treatment, and the like. For forming the mixed crystal state, there may be mentioned a method of mixing two types of crystals, then mechanically grinding them to change the shape into an amorphous shape, and subsequently converting them into those having a specific crystal state through a solvent treatment, as described in JP-A-10-48859.

In the case where an azo pigment is used as the charge generation substance, it is preferable to use various types of bisazo pigments and trisazo pigments. In the case where an organic pigment is used as the charge generation substance, one of the pigment may be used alone, but two or more of the pigments may be used as a mixture. In this case, it is preferable that two or more of such charge generation substances each having a spectral sensitivity characteristic in a different spectral region of a visible light range or a near-IR range are used in combination. In particular, it is more preferable to use a disazo pigment or a trisazo pigment and a phthalocyanine pigment in combination.

[Binder Resin]

The binder resin to be used in the charge generation layer is not particularly limited. Examples thereof include insulating resins such as poly(vinyl acetal)-based resins such as poly(vinyl butyral) resins, poly(vinyl formal) resins, and partly acetalized poly(vinyl butyral) resins in which a part of the butyral moieties have been modified with formal, acetal, or the like, polyarylate resins, polycarbonate resins, polyester resins, modified ether-based polyester resins, phenoxy resins, poly(vinyl chloride) resins, poly(vinylidene chloride) resins, poly(vinyl acetate) resins, polystyrene resins, acrylic resins, methacrylic resins, polyacrylamide resins, polyamide resins, polyvinylpyridine resins, cellulose-based resins, polyurethane resins, epoxy resins, silicone resins, poly(vinyl alcohol) resins, polyvinylpyrrolidone resins, casein, copolymers based on vinyl chloride and vinyl acetate, such as vinyl chloride/vinyl acetate copolymers, hydroxy-modified vinyl chloride/vinyl acetate copolymers, carboxyl-modified vinyl chloride/vinyl acetate copolymers, and vinyl chloride/vinyl acetate/maleic anhydride copolymers, styrene/butadiene copolymers, vinylidene chloride/acrylonitrile copolymers, styrene/alkyd resins, silicone/alkyd resins, and phenol/formaldehyde resins, and organic photoconductive polymers such as poly(N-vinylcarbazole), polyvinylanthracene, and polyvinylperylene, and the like. Any one of these binder resins may be used alone, or any desired combination of two or more thereof may be used as a mixture.

In the charge generation layer, the ratio (mass) of the binder resin to the charge generation substance is in the range of usually 10 parts by mass or more, preferably 30 parts by mass or more and usually 1,000 parts by mass or less, preferably 500 parts by mass or less relative to 100 parts by mass of the binder resin.

As the method of dispersing the charge generation substance, employable is any known dispersion method such as a ball mill dispersion method, an attritor dispersion method, a sand mill dispersion method, and a bead mill dispersion method. On this occasion, it is effective to finely disperse the particles into those having a particle size of preferably 0.5 μm or less, more preferably 0.3 μm or less, further preferably 0.15 μm or less.

<Charge Transport Layer>

The charge transport layer of the invention can be obtained by dissolving or dispersing a charge transport substance or the like, a binder resin, and a particulate silicon compound in a solvent to manufacture a coating liquid and applying the coating liquid onto the charge generation layer, followed by drying. The thickness of the charge transport layer is not particularly limited but is usually 5 μm or more and, from the viewpoint of high resolution, is preferably 10 μm or more, and more preferably 15 μm or more. Also, it is generally 50 μm or less and, from the viewpoints of electrical properties and image stability, is preferably 35 μm or less, and more preferably 25 μm or less.

It is also preferable to incorporate well-known additives such as a plasticizer, a lubricant, a dispersion aid, an antioxidant, an ultraviolet absorber, an electron-withdrawing compound, a dye, a pigment, a sensitizer, a leveling agent, a stabilizer, a fluidity-imparting agent, or a crosslinking agent, in order to improve film-forming properties, flexibility, applicability, non-fouling properties, gas resistance, light resistance, etc. or to further improve mechanical strength of the photosensitive layer.

Examples of the antioxidant include hindered phenol compounds, hindered amine compounds, and the like. Examples of the dye and pigment include various colorant compounds, azo compounds, and the like. Examples of the leveling agent include silicone oils, fluorine-based surfactants, and the like.

[Particulate Silicon Compound]

Examples of the particulate silicon compound include silicon nitride, silicon carbide, silicon dioxide, and the like and, from the viewpoint of electrical properties of the photoreceptor, silicon dioxide (silica particles) is preferred. The silica particles are produced by a vapor phase process or a liquid phase process. Preferred are silica particles in which silica particle surface is surface-modified with a reactive silicon compound.

The average primary particle diameter of the particulate silicon compound is preferably 1.0 μm or less, more preferably 0.9 μm or less, and further preferably 0.8 μm or less from the viewpoint of coating liquid stability. On the other hand, from the viewpoint of abrasion resistance, it is preferably 0.01 μm or more. Moreover, from the viewpoint of filming resistance, it is more preferably 0.1 μm or more, further preferably 0.3 μm or more, and particularly preferably 0.4 μm or more. The average primary particle diameter can be grasped by the measurement on a scanning electron microscope (SEM) or a transmittance electron microscope (TEM). In the case of 0.01 μm or more and 2 μm or less, dispersibility particularly tends to be poor and an effect of improving dispersion is large when it is used in combination with a specific charge transport substance.

The content of the particulate silicon compound is preferably 5% by mass or more in the solid content in the charge transport layer. From the viewpoint of filming resistance, the content is more preferably 6% by mass or more. On the other hand, it is usually 30% by mass or less. From the viewpoints of dispersibility and electrical properties, it is preferably 15% by mass or less.

The particles of the particulate silicon compound are preferably surface-treated with a reactive organosilicon compound. As the surface treatment, production can be performed by a dry process or a wet process. In the dry process, a surface treating agent is mixed with metal oxide particles to thereby coat the metal oxide particles therewith and, if necessary, a heating treatment is performed, thereby achieving the production. In the wet process, metal oxide particles and a mixture of the surface treating agent of the invention with an appropriate solvent are well stirred until the agent is uniformly attached or are mixed in a media, then dried, and, if necessary, subjected to a heating treatment, thereby achieving the production.

Examples of the reactive organosilicon compound include silane coupling agents, silane treating agents, siloxane compounds, and the like but, from the viewpoints of reactivity with particulate organosilicon compound and suppression of formation of reactive aggregated particles in which unreacted sites are prone to remain, the silane treating agents are preferred. Of the silane treating agents, preferred are silane treating agents containing an alkyl group having 1 to 3 carbon atoms.

Examples of the silane treating agents include hexamethyldisilazane, trimethylmethoxysilane, trimethylethoxysilane, trimethylchlorosilane, dimethyldichlorosilane, dimethyldimethoxysilane, dimethylethoxysilane, methyldimethoxysilane, methyltrimethoxysilane, methyltriethoxysilane, and the like.

The particulate silicon compound after the surface treatment has been mostly treated with the reactive silicone compound but there is a case where a hydroxyl group remains. The presence thereof can be judged by an absorption peak attributable to the silanol hydroxyl group on the surface of the particulate silicon compound observed by an infrared spectroscopy. With regard to the remaining of the hydroxyl group by the treatment, since the variation of electrical properties of the photoreceptor caused by humidity change increases as the remaining ratio of the group increases, the absorption peak of the silanol hydroxyl group is preferably 10% or less, more preferably 5% or less relative to the peak before the treatment.

The sphericity of the particulate silicon compound is usually 0.95 or more, preferably 0.96 or more, and more preferably 0.98 or more from the viewpoint of crack resistance. As the sphericity increases, the surface area of the particles decreases and thus the interface to be a cause of cracks decreases, so that cracks are less prone to occur.

The density of the particulate silicon compound is usually 1.5 g/cm$^3$ or more, preferably 1.8 g/cm$^3$ or more, and more preferably 2.0 g/cm$^3$ or more from the viewpoint of crack resistance. Also, from the viewpoint of crack resistance, the density is usually 3.0 g/cm$^3$ or less, preferably 2.8 g/cm$^3$ or less, and more preferably 2.5 g/cm$^3$ or less.

[Charge Transport Substance]

The charge transport substance to be used in the invention is a monotriphenylamine compound having a substituent represented by the following general formula (1).

[Chem 12]

General Formula (1)

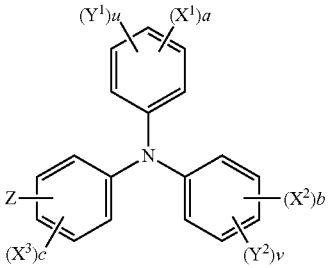

wherein $X^1$ to $X^3$ each independently represent an alkyl group, an alkoxy group, an aryl group, or an aryloxy group and a to c each independently represent 0 to 5; $Y^1$ and $Y^2$ each independently represents an alkenyl structure represented by the following general formula (A) and u and v each independently represents 0 to 3; z represents an alkenyl structure represented by the following general formula (B):

[Chem 13]

General Formula (A)

$$-(CR^1{=}CR^2)_m-CR^3{=}CR^4R^5$$

wherein $R^1$ to $R^4$ each independently represent a hydrogen atom, an alkyl group, or an aryl group, $R^5$ represents an aryl group, and m represents 0 to 3;

[Chem 14]

$$-HC{=}HC-CH{=}CH-Ar^1$$ General Formula (B)

wherein $Ar^1$ represents an aryl group.

Specifically, in $X^1$ to $X^3$, examples of the alkyl group include linear alkyl groups such as a methyl group, an ethyl group, an n-propyl group, an n-butyl group, an n-hexyl group, and an n-octyl group; branched alkyl groups such as an isopropyl group, an ethylhexyl group, and a tertiary butyl group, and cyclic alkyl groups such as a cyclohexyl group.

Examples of the alkoxy group include linear alkoxy groups such as a methoxy group, an ethoxy group, an n-propoxy group, and an n-butoxy group; branched alkoxy groups such as an isopropoxy group and an ethylhexyloxy group; cyclic alkoxy groups such as a cyclohexyloxy group; and alkoxy groups having a fluorine atom, such as a trifluoromethoxy group, a pentafluoroethoxy group, and a 1,1,1-trifluoroethoxy group.

Examples of the aryl group include a phenyl group, a naphthyl group, a biphenyl group, an anthryl group, a phenanthryl group, a tolyl group, an anisyl group, and the like. As the aryloxy group, there may be mentioned a group in which an oxygen atom is incorporated into the group mentioned as the aryl group. Of these, in view of electrical properties, the alkyl group or the alkoxy group is preferred and the alkyl group is more preferred. Furthermore, from the viewpoint of dispersibility, an alkyl group having 1 to 10 carbon atoms is preferred and an alkyl group having 3 to 8 carbon atoms is more preferred. When a to c are too large, the number of effective molecules decreases owing to an increase in molecular weight, so that it is preferable to select them from the range of 0 to 2. From the viewpoint of electrical properties, c is preferably 0. It is preferable that either a or b is 1 and the other is 0.

In $R^1$ to $R^5$ and $Ar^1$, to the alkyl group and the aryl group, those mentioned in $X^1$ to $X^3$ can apply. The contribution of the monotriphenylamine compound of the invention to the dispersion stability of the particulate silicon compound is attributable to both of interaction between the terminal aryl groups of $Y^1$, $Y^2$, and Z in the above general formula (1) and the particulate silicon compound and entanglement of the monotriphenylamine unit into the polymer molecule. Therefore, u and v are preferably each 0 or 1 and either u or v is preferably 1 so that the entanglement of the monotriphenylamine unit into the polymer molecule is not inhibited by the alkenyl unit.

Further, with regard to the alkenyl chain length of the above general formula (A), it is preferable for the dispersion stability of the particulate silicon compound in the coating liquid that the monotriphenylamine unit and the aryl group end can keep a certain degree of distance and both of the entanglement of the monotriphenylamine unit with the polymer chain and the stabilization by the interaction between the particulate silicon compound and the terminal aryl group of the alkenyl unit are not influenced by any steric factors. However, when the alkenyl chain is too long, it becomes weak to oxidative degradation. For the both reasons, m is preferably 1 or 2. Moreover, in order to avoid the influence of the steric factor owing to the substituent of the alkenyl unit similarly, $R^1$ to $R^4$ are preferably each a hydrogen atom.

In the above general formula (1), with regard to the positions of $X^1$ to $X^3$, $Y^1$ and $Y^2$, it is preferable to position each of them at a para position or an ortho position starting with the carbon to which the nitrogen atom is bonded, the nitrogen atom being one to which the phenyl rings of the triphenylamine are bonded. Also, it is preferable that at least one of $X^1$ to $X^3$, $Y^1$, and $Y^2$ is positioned at a para position in view of the electrical properties resulting from the electron-donating effect or resonance effect of the substituent(s).

From the viewpoint of dispersibility, it is particularly preferable that, in the above general formula (1), a=1, b=0, c=0, v=1, and u=0, and $Y^2$ and Z are substituted at a para position starting with the carbon atom to which the nitrogen atom is bonded, and, in the above general formula (A), m=1, $R^1$ to $R^4$ are each a hydrogen atom, and $R^5$ is an aryl group.

An object of the invention is to provide a coating liquid for electrophotographic photoreceptor production comprising a charge transport substance, a binder resin, and a particulate silicon compound, which has good dispersibility. The mechanism of exhibition of the effect of stabilization of the coating liquid is considered as follows.

In the coating liquid containing an organic solvent, a binder resin, and a particulate silicon compound, the particulate silicon compound is present with being surrounded with the binder resin molecules but the rigid skeleton unit of the binder resin is less prone to contribute to the dispersion stabilization of the particulate silicon compound. On the other hand, the co-existing charge transport substance has a monotriphenylamine unit and an alkenyl substituent having an aryl substituent at an end in the case of the invention. Thus, the substance contributes to the stabilization of the coating liquid as a whole by the facts that the triphenylamine unit plays a role as an anchor through entanglement into the binder resin and the aryl group at the end of the alkenyl group performs an interaction with the surface of the particulate silicon compound.

Of the charge transport substances represented by the general formula (1), from the viewpoints of dispersibility and electrical properties, a charge transport substance represented by the following general formula (2) is preferred.

[Chem 15]

General Formula (2)

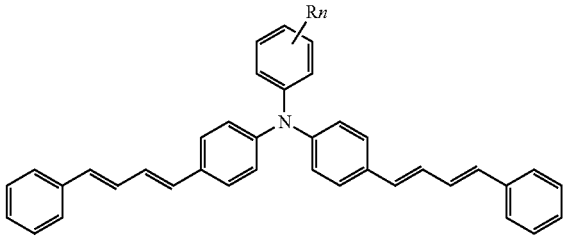

wherein R is an alkyl group or alkoxy group having 8 or less carbon atoms; n represents an integer of 0 to 3; and when n is 2 or 3, R(s) each independently represent an alkyl group or alkoxy group having 8 or less carbon atoms.

Of these, from the viewpoints of electrical properties and dispersibility of the particulate silicon compound, preferred is at least one charge transport substance selected from the compound group represented by the general formulae (1A), (1B), (1C), (1D), and (1E).

[Chem 16]

(1 A)

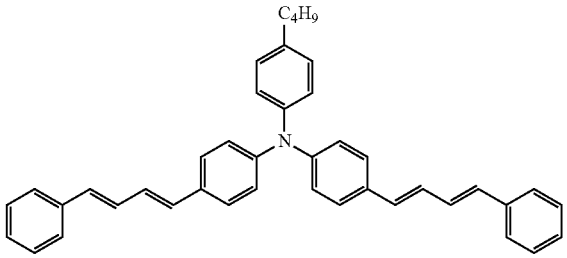

(1 B)

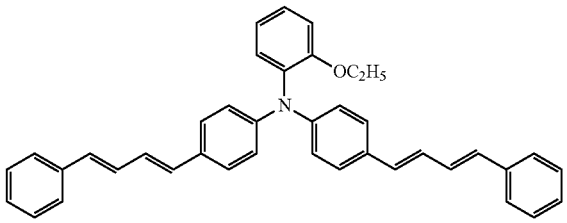

-continued

[Chem 17]

(1 C)

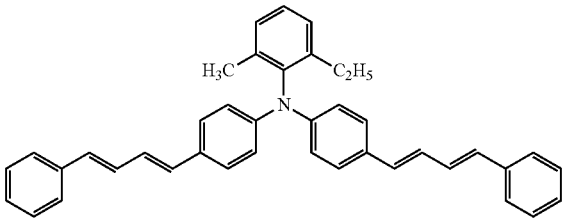

(1 D)

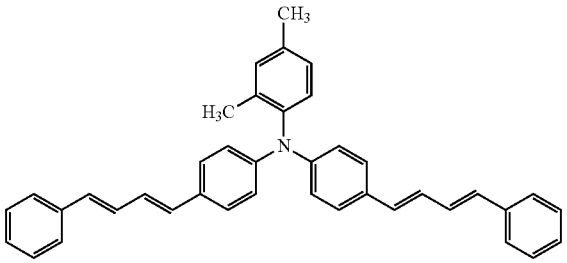

[Chem 18]

(1 E)

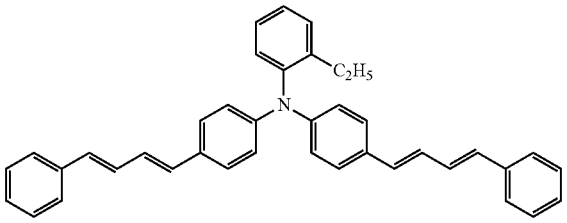

In the invention, as a charge transport substance, the charge transport substance represented by the above general formula (1) may be used alone or it is possible to use it in combination with the other charge transport substance.

The following exemplify structures of charge transport substances suitable for the invention. The following structures are exemplified for describing the invention more specifically and the substance should not be construed as being limited to the following structures unless they deviate from the concept of the invention.

[Chem 19]

(1)-1

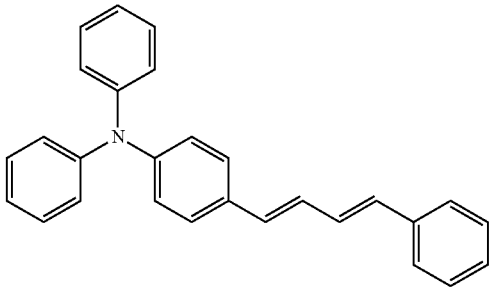

-continued
(1)-2
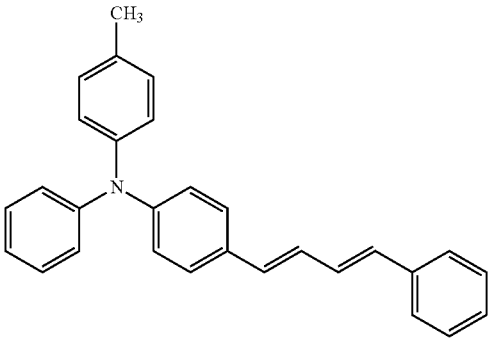
(1)-3
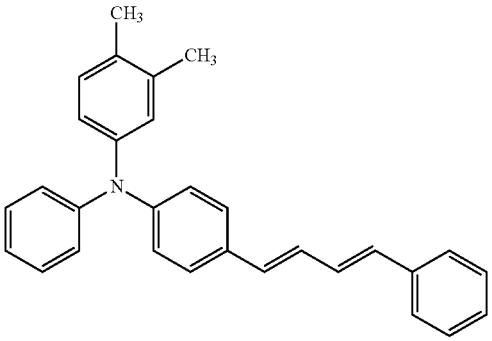
(1)-4
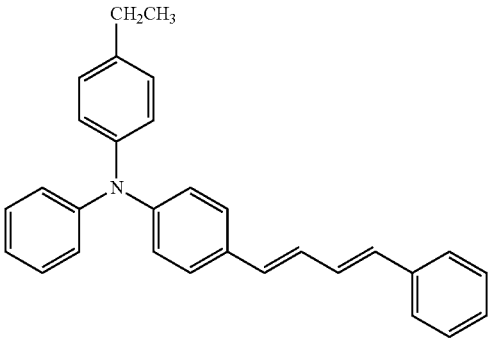
[Chem 20]
(1)-5
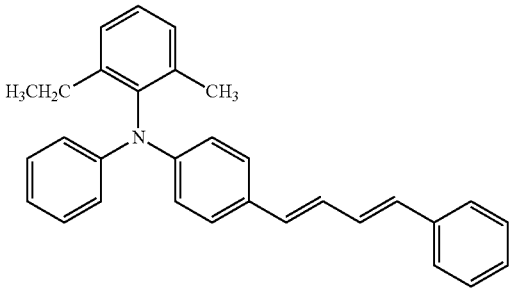
-continued
(1)-6
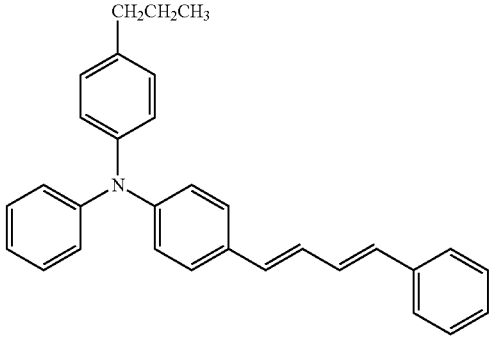
(1)-7
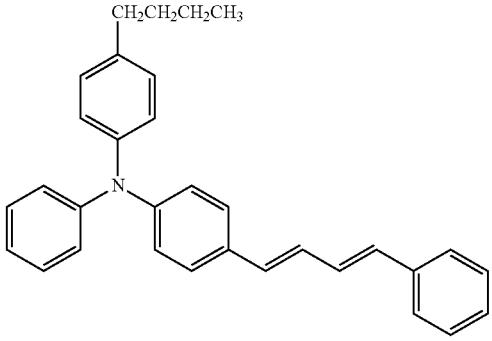
(1)-8
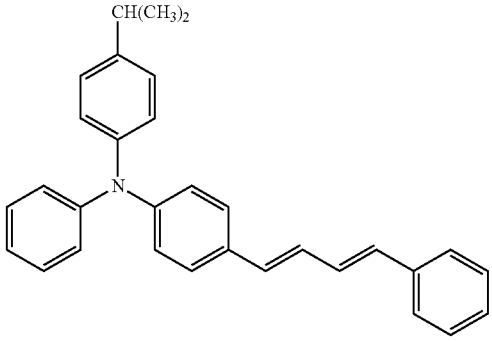
[Chem 21]
(1)-9
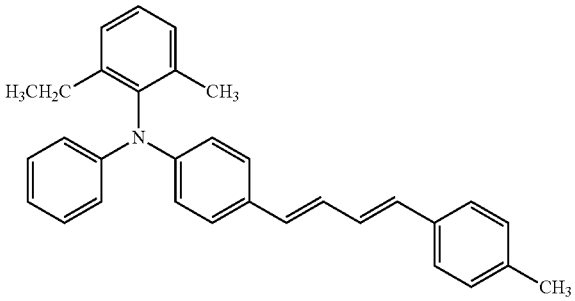

-continued
(1)-10
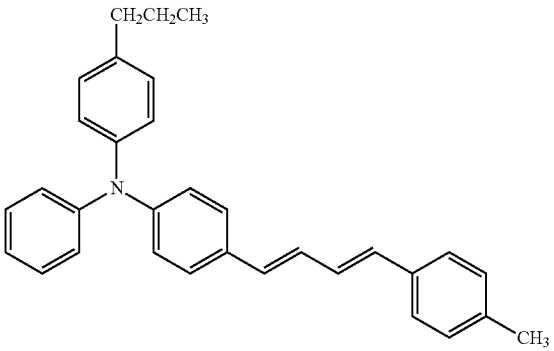
(1)-11
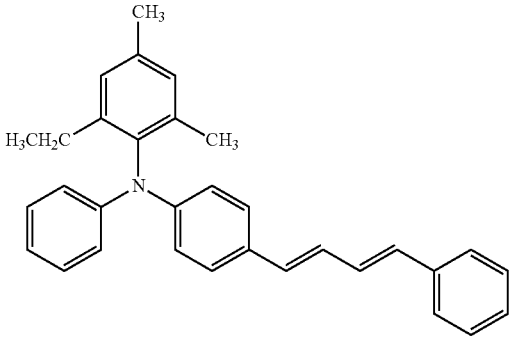
(1)-12
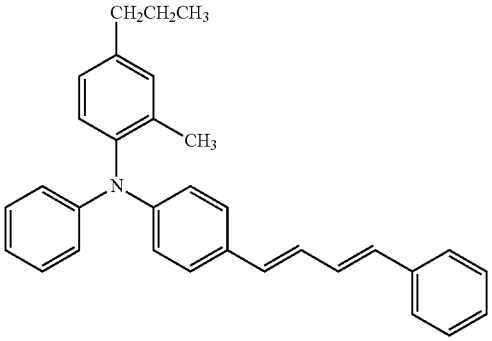
(1)-13
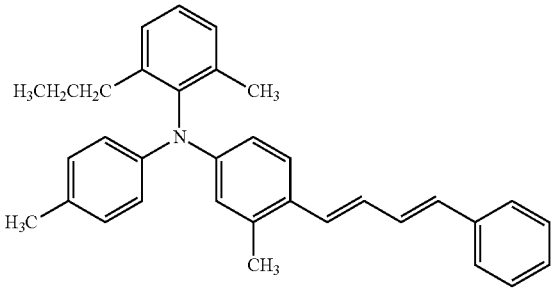
-continued
(1)-14
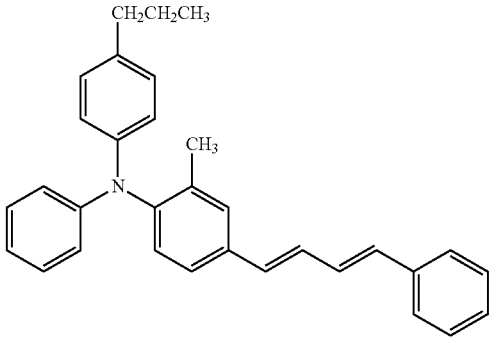
[Chem 22]
(1)-15
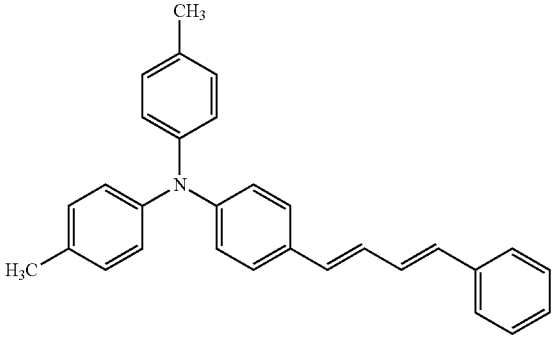
(1)-16
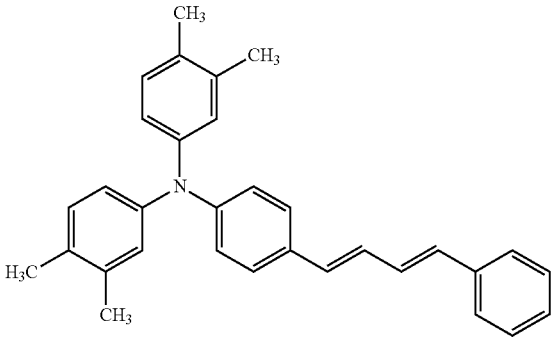
(1)-17
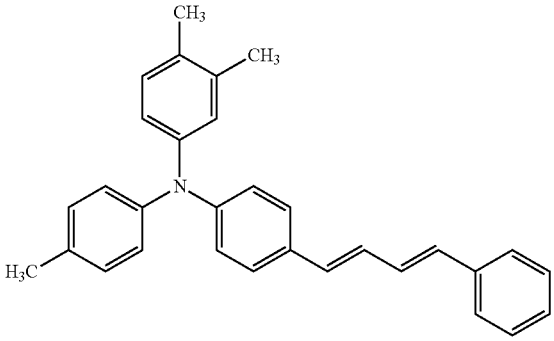

-continued
(1)-18
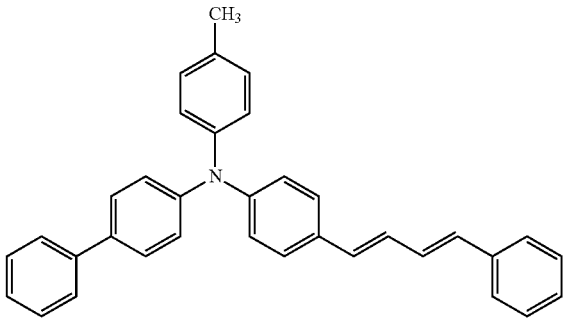
[Chem 23]
(1)-19
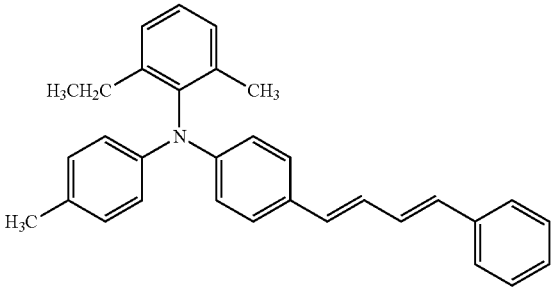
(1)-20
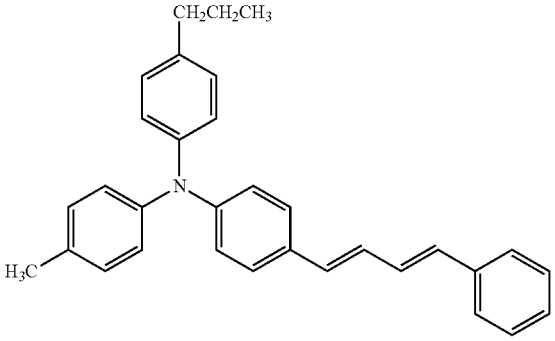
(1)-21
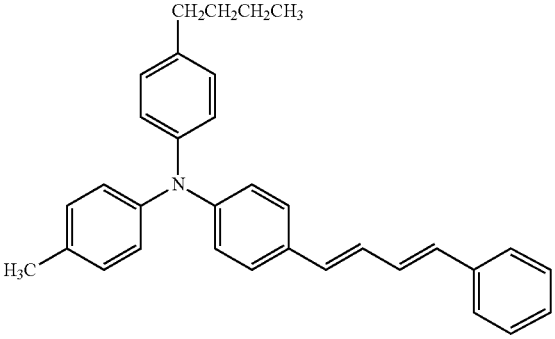
-continued
(1)-22
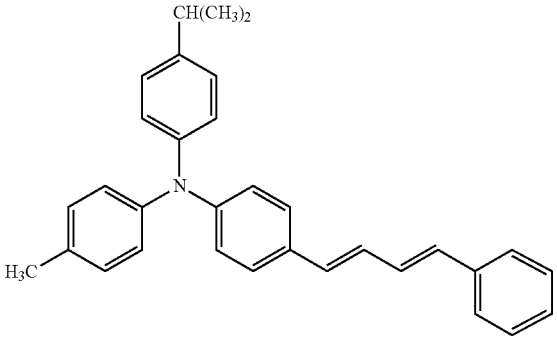
[Chem 24]
(1)-23
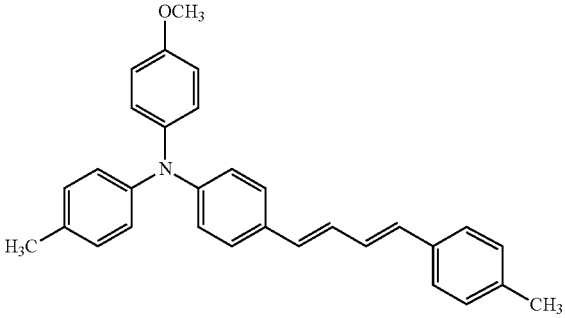
(1)-24
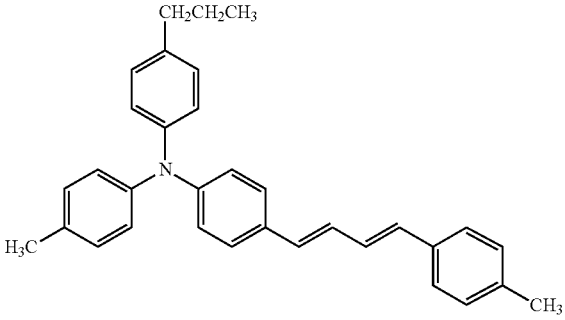
(1)-25
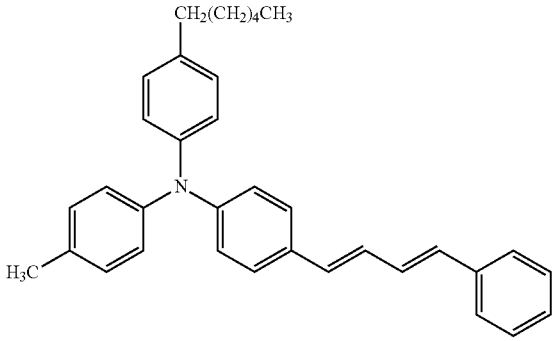

-continued
(1)-26
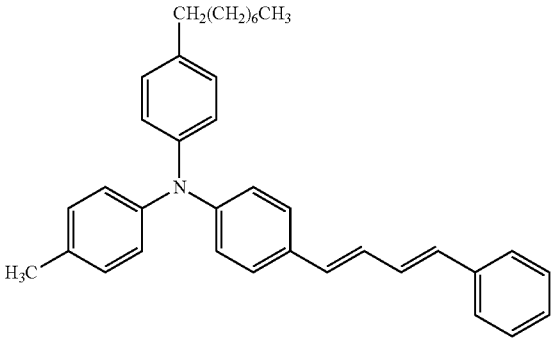
(1)-27
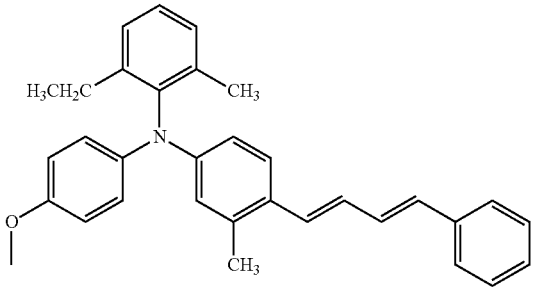
(1)-28
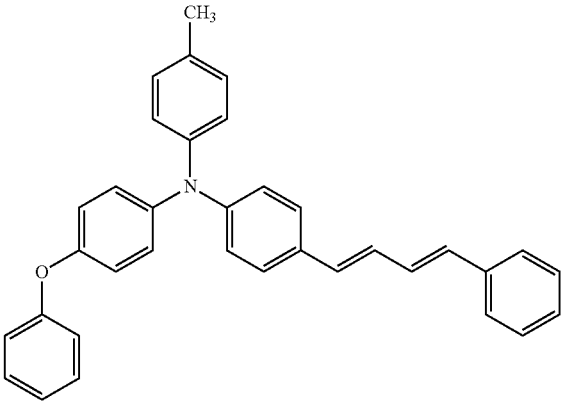
[Chem 25]
(2)-1
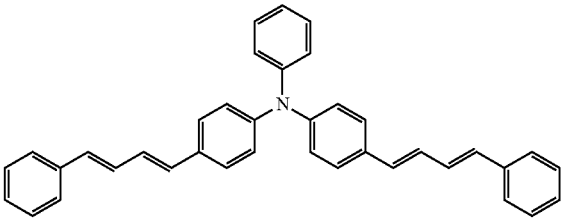
-continued
(2)-2
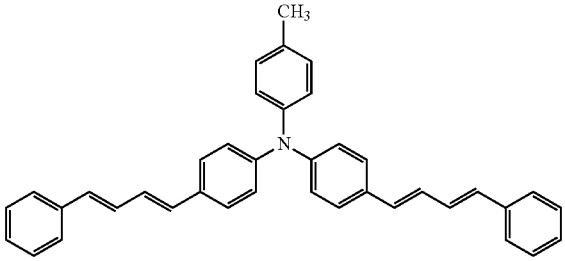
(2)-3
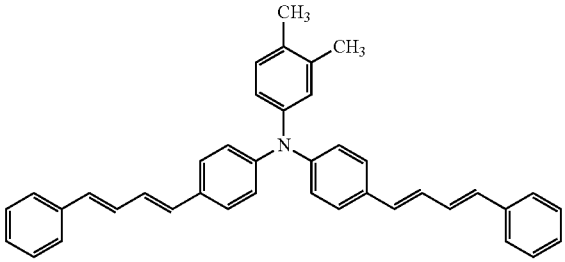
(2)-4
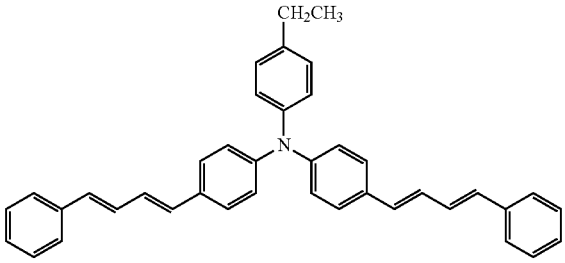
[Chem 26]
(2)-5
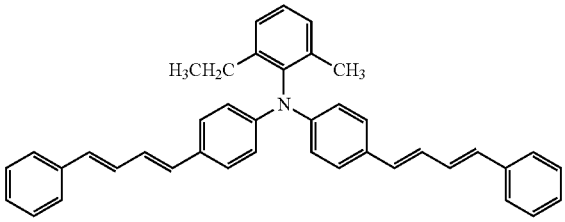
(2)-6
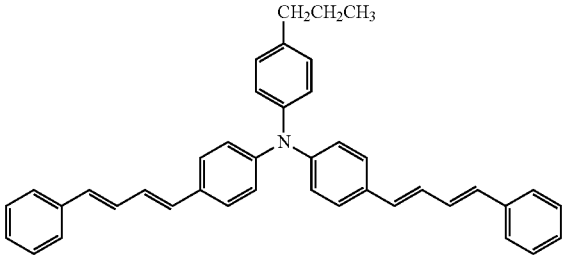

-continued
(2)-7
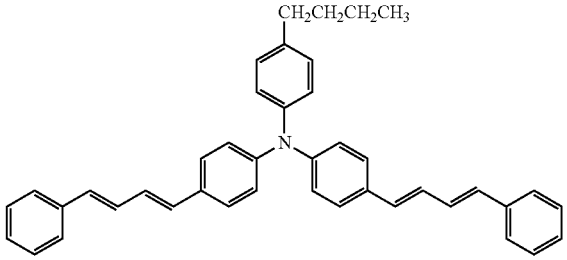
(2)-8
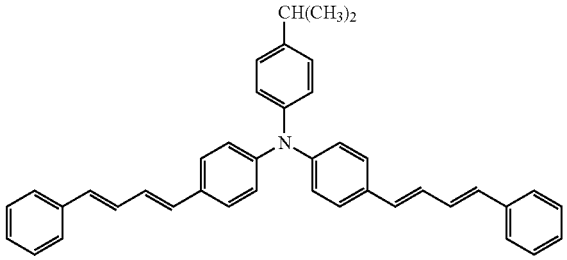
[Chem 27]
(2)-9
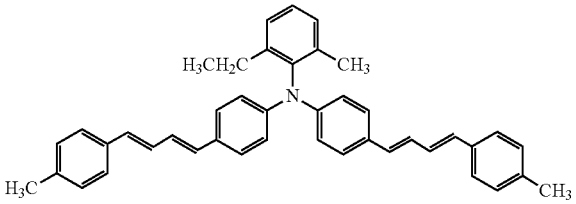
(2)-10
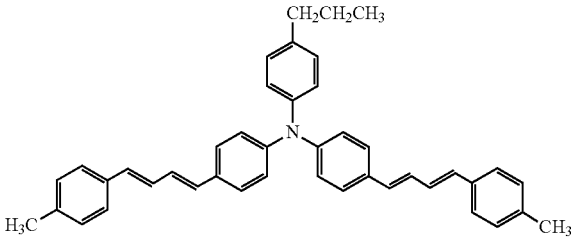
(2)-11
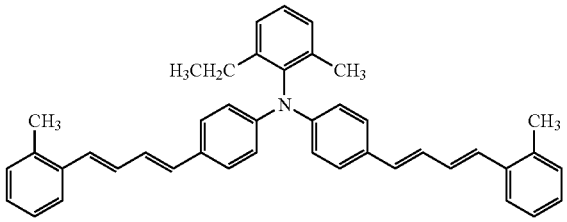
(2)-12
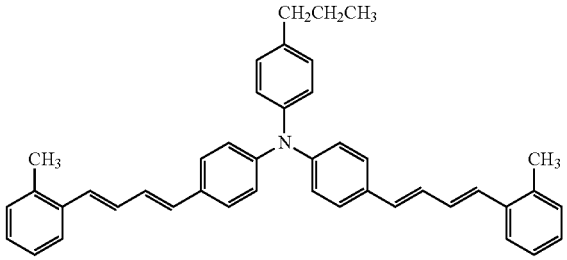
-continued
[Chem 28]
(2)-13
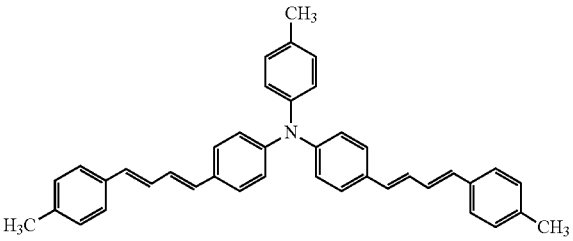
(2)-14
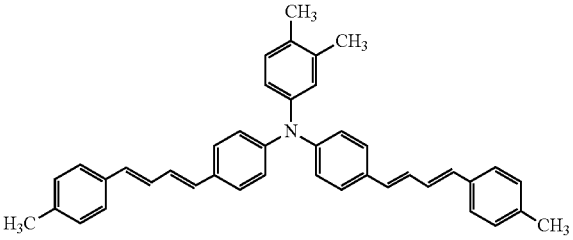
(2)-15
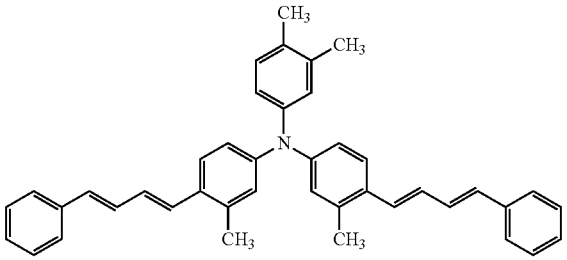
(2)-16
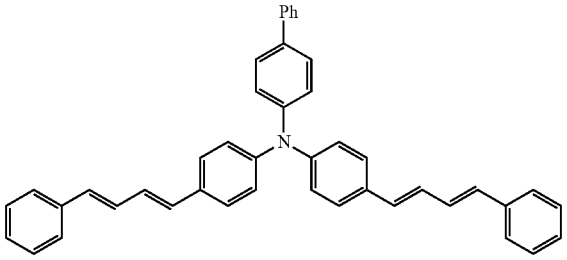
[Chem 29]
(2)-17
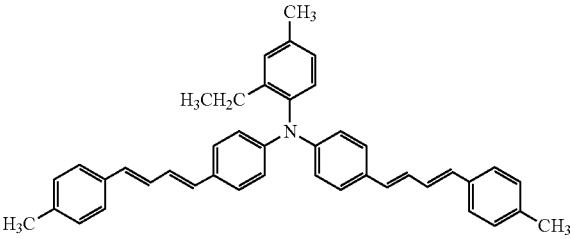

-continued
(2)-18
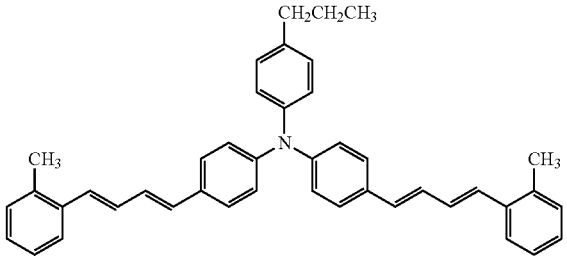
(2)-19
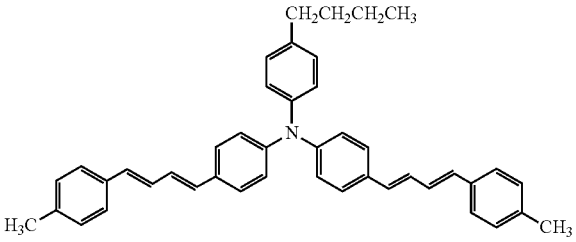
(2)-20
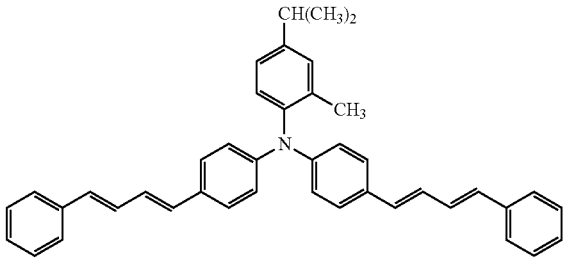
[Chem 30]
(2)-21
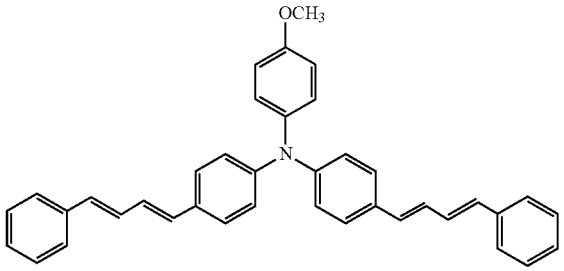
(2)-22
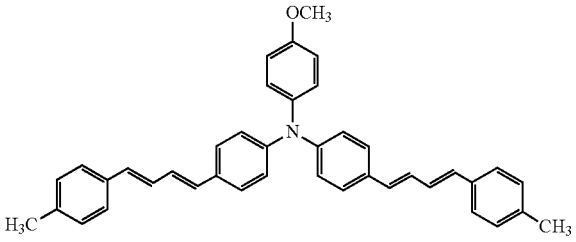
-continued
(2)-23
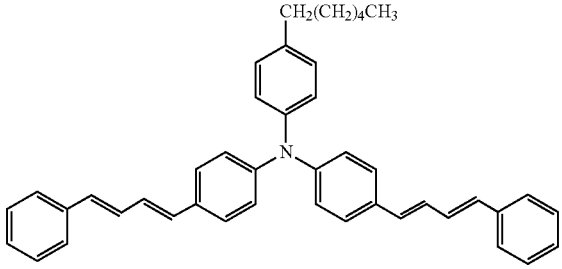
(2)-24
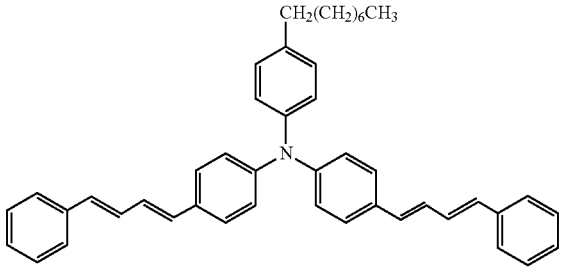
[Chem 31]
(2)-25
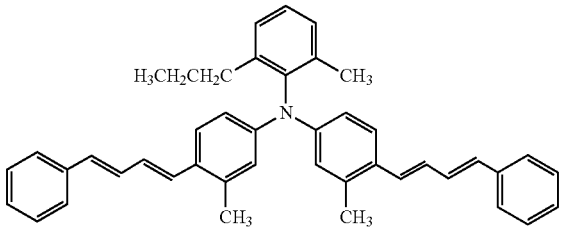
(2)-26
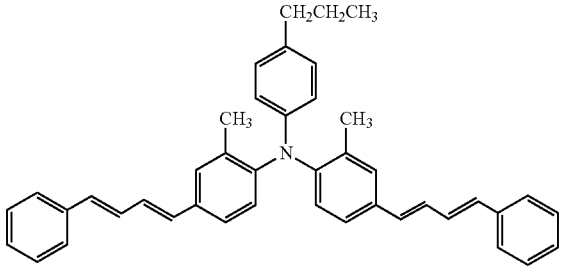
(2)-27
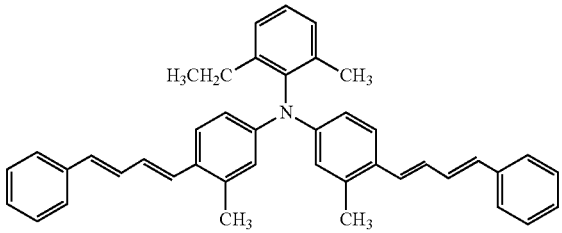

-continued (2)-28

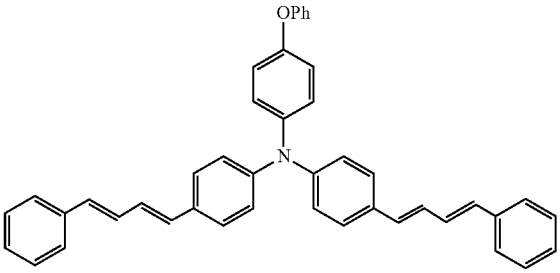

[Chem 32]

(2)-29

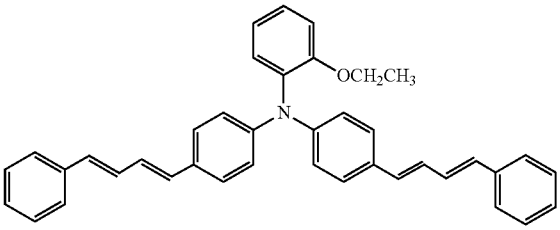

(2)-30

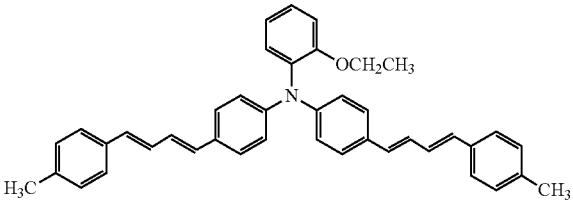

(2)-31

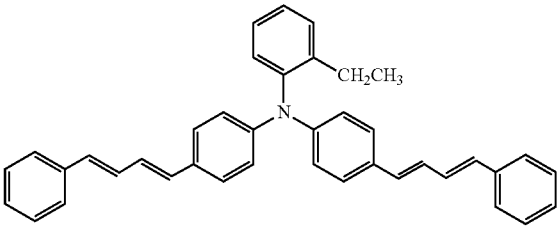

-continued (2)-32

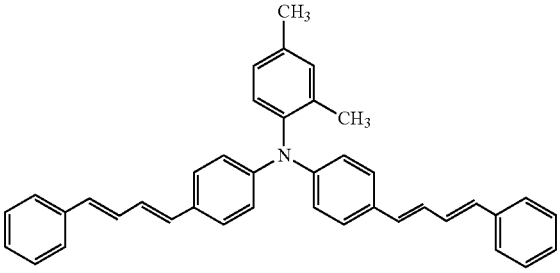

[Binder Resin]

The charge transport layer is formed in a form that the aforementioned charge transport substance is bound with a binder resin. Examples of the binder resin to be used in the charge transport layer include vinyl polymers such as poly(methyl methacrylate), polystyrene, and poly(vinyl chloride) and copolymers thereof; and polycarbonate resins, polyarylate resins, polyester resins, polyestercarbonate resins, polysulfone resins, polyamide resins, phenoxy resins, epoxy resins, silicone resins, and the like. Moreover, partially crosslinked cured products thereof can be also used. Of these binder resins, particularly preferred are polycarbonate resins and polyarylate resins from the viewpoint of electrical properties of the photoreceptor. These resins may be used alone or as a mixture of a plurality thereof.

Specific examples of preferable structures of the binder resins are shown below. These examples are shown for exemplification, and any known binder resin may be mixed and used unless the use thereof departs from the gist of the invention.

[Chem 33]

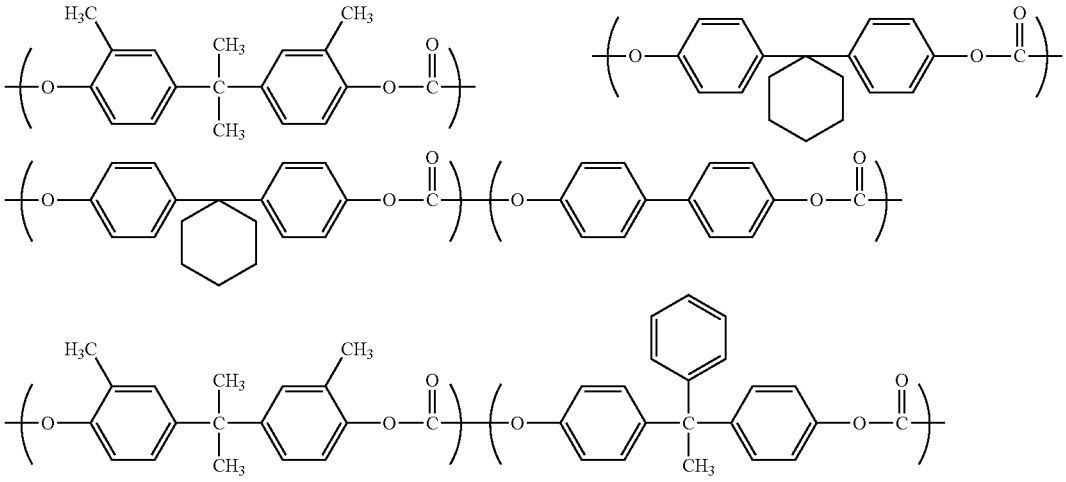

-continued

[Chem 34]

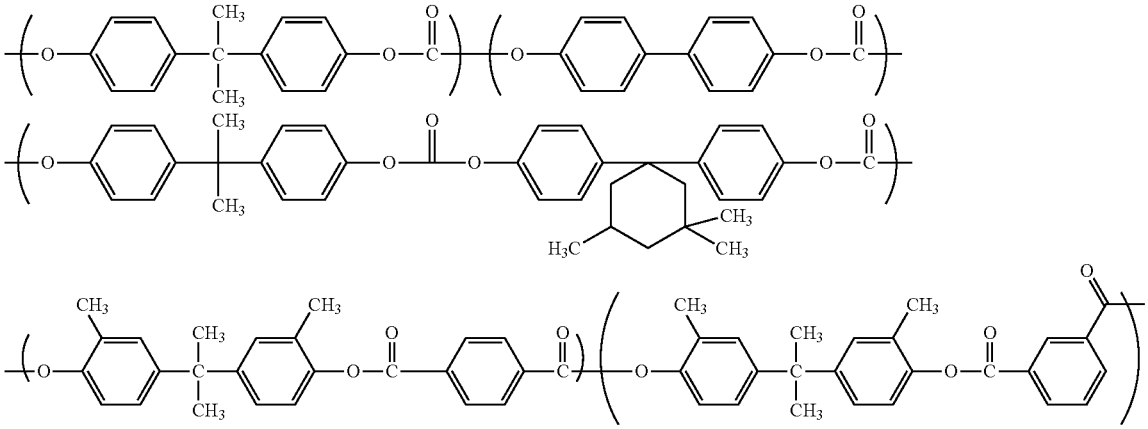

[Chem 35]

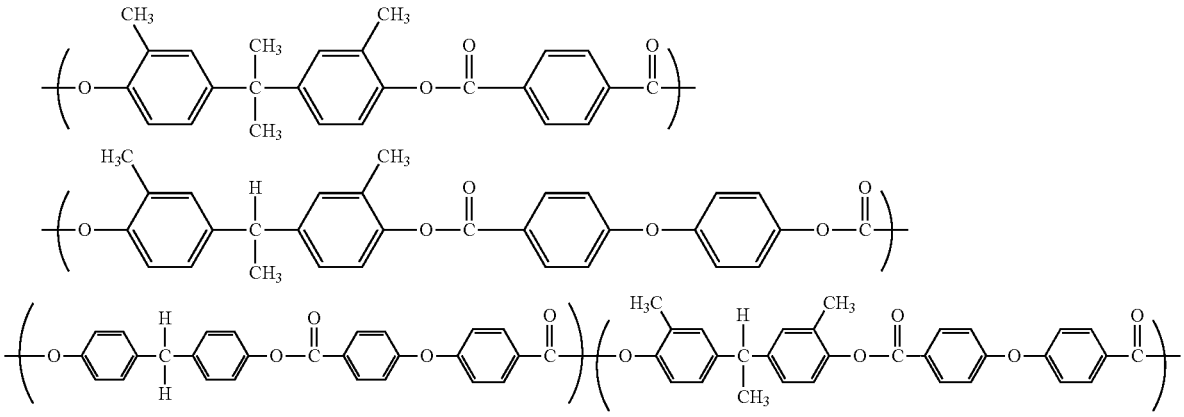

With respect to the ratio of the binder resin in the charge transport layer to the charge transport substance, the charge transport substance may be used in a ratio of usually 30 parts by mass or more as a lower limit relative to 100 parts by mass of the binder resin and is preferably 40 parts by mass or more, from the viewpoints of stability and charge mobility during repeated use. On the other hand, from the viewpoints of thermal stability of the photosensitive layer and abrasion resistance, the charge transport substance is used in a ratio of usually 150 parts by mass or less as an upper limit. From the viewpoint of compatibility between the charge transport substance and the binder resin, the ratio is preferably 120 parts by mass or less, and more preferably 60 parts by mass or less.

The viscosity-average molecular weight (Mv) of the binder resin is usually 20,000 or more and, from the viewpoint of printing durability, is more preferably 30,000 or more, and further preferably 40,000 or more. On the other hand, the molecular weight is usually 200,000 or less and, from the viewpoint of applicability, preferably 100,000 or less, and further preferably 80,000 or less.

[Electron-Withdrawing Compound]

Examples of the electron-withdrawing compound include cyano compounds such as tetracyanoquinodimethane, dicyanoquinomethane, or aromatic esters having a dicyanoquinovinyl group, nitro compounds such as 2,4,6-trinitrofluorenone, condensed polycyclic aromatic compounds such as perylene, diphenoquinone derivatives, quinones, aldehydes, ketones, esters, acid anhydrides, phthalides, metal complexes of substituted or unsubstituted salicylic acids, metal salts of substituted or unsubstituted salicylic acids, metal complexes of aromatic carboxylic acids, and metal salts of aromatic carboxylic acids. Preferably, there are used cyano compounds, nitro compounds, condensed polycyclic aromatic compounds, diphenoquinone derivatives, metal complexes of substituted or unsubstituted salicylic acids, metal salts of substituted or unsubstituted salicylic acids, metal complexes of aromatic carboxylic acids, and metal salts of aromatic carboxylic acids.

[Organic Solvent]

Examples of the organic solvent to be used in the coating liquid for charge transport layer formation include ethers such as tetrahydrofuran, 1,4-dioxane, and dimethoxyethane, esters such as methyl formate and ethyl acetate, ketones such as acetone, methyl ethyl ketone and cyclohexanone, aromatic hydrocarbons such as benzene, toluene, and xylene, chlorinated hydrocarbons such as dichloromethane, chloroform, 1,2-dichloroethane, 1,1,2-trichloroethane, 1,1,1-trichloroethane, tetrachloroethane, 1,2-dichloropropane, and trichloroethylene, nitrogen-containing compounds such as n-butylamine, isopropanolamine, diethylamine, triethanolamine, ethylenediamine, and triethylenediamine, aprotic polar solvents such as acetonitrile, N-methylpyrrolidone, N,N-dimethylformamide, and dimethyl sulfoxide, and the like.

Of these, from the viewpoint of suppression of brushing, it is preferable to contain an ether having a boiling point of 90° C. or lower and an ether having a boiling point of 120°

C. or higher. Moreover, it is more preferable to contain an ether having a boiling point of 90° C. or lower as a main component and an ether having a boiling point of 120° C. or higher in an amount of 5% by mass to 50% by mass.

As the ether having a boiling point of 90° C. or lower, from the viewpoints of brushing resistance and safety, an ether having a boiling point of 50° C. or higher is preferred and an ether having a boiling point of 60° C. or higher is more preferred. Examples of the ether include tetrahydrofuran, dimethoxyethane, dioxolane, methyltetrahydrofuran, tetrahydropyran, and the like. In view of solubility of the binder resin and the like, a cyclic ether is preferred and tetrahydrofuran is especially preferred.

The content of the ether having a boiling point of 90° C. or lower is 50% by mass or more in the total organic solvent but is, in view of drying rate of the coated film, preferably 60% by mass or more, and more preferably 75% by mass or more. On the other hand, from the viewpoint of brushing resistance, the content is preferably 90% by mass or less, and more preferably 85% by mass or less.

As the ether having a boiling point of 120° C. or higher, from the viewpoints of a drying rate and a residual solvent, an ether having a boiling point of 200° C. or lower is preferred and an ether having a boiling point of 170° C. or lower is more preferred. Examples of the ether include diethoxyethane, anisole, 2,2-ditetrahydrofurfurylpropane, and the like. Of these, aromatic ethers are preferred and anisole is especially preferred.

The content of the ether having a boiling point of 120° C. or higher is preferably 10% by mass or more, and more preferably 15% by mass or more in the total organic solvent in view of brushing resistance. On the other hand, from the viewpoint of the drying rate, the content is preferably 30% by mass or less, and more preferably 25% by mass or less.

In addition to the ether having a boiling point of 90° C. or lower and the ether having a boiling point of 120° C. or higher, any organic solvent may be incorporated in the range where the binder resin is not precipitated. Examples of the ether include ethers having a boiling point of 90° C. or higher and 120° C. or lower, ketones such as methyl ethyl ketone, alcohols having 4 or more carbon atoms, and the like. The content of the organic solvent is preferably from 60 to 95% by mass, more preferably from 70 to 90% by mass, and particularly preferably from 75 to 85% by mass.

<Method for Forming Each Layer>

The layers constituting the photoreceptor are formed by repeating the application and drying steps of a coating liquid, which is obtained by dissolving or dispersing the materials to be incorporated in a solvent, on a support, successively for each layer, by a known technique, such as dip coating, spray coating, nozzle coating, bar coating, roll coating, or blade coating.

The solvent or dispersion medium to be used is not particularly limited. However, specific examples thereof include ethers such as tetrahydrofuran, 1,4-dioxane, and dimethoxyethane; esters such as methyl formate and ethyl acetate; ketones such as acetone, methyl ethyl ketone, and cyclohexanone; aromatic hydrocarbons such as benzene, toluene, and xylene; chlorinated hydrocarbons such as dichloromethane, chloroform, 1,2-dichloroethane, 1,1,2-trichloroethane, 1,1,1-trichloroethane, tetrachloroethane, 1,2-dichloropropane, and trichloroethylene; nitrogen-containing compounds such as n-butylamine, isopropanolamine, diethylamine, triethanolamine, ethylenediamine, and triethylenediamine; aprotic polar solvents such as acetonitrile, N-methylpyrrolidone, N,N-dimethylformamide, and dimethyl sulfoxide; and the like. One of these compounds may be used alone, or two or more compounds of any desired combination and any desired kinds may be used in combination.

The amount of the solvent or dispersion medium to be used is not particularly limited. It is, however, preferable to suitably regulate the amount thereof so that the physical properties of the coating liquid, such as solid concentration and viscosity, fall within desired ranges, while taking account of the purpose of each layer and the nature of the selected solvent or dispersion medium.

In the case of the charge transport layer, the solid concentration of each coating liquid is usually 5% by mass or more, preferably 10% by mass or more, and is usually 40% by mass or less, preferably 35% by mass or less. Furthermore, the viscosity of the coating liquid is usually 10 cps or more, preferably 50 cps or more, and is usually 500 cps or less, preferably 400 cps or less.

In the case of the charge generation layer, the solid concentration of the coating liquid is usually 0.1% by mass or more, preferably 1% by mass or more, and is usually 15% by mass or less, preferably 10% by mass or less. Moreover, the viscosity of the coating liquid is usually 0.01 cps or more, preferably 0.1 cps or more, and is usually 20 cps or less, preferably 10 cps or less.

As methods for applying the coating liquid, there may be mentioned a dip coating method, a spray coating method, a spinner coating method, a bead coating, a wire bar coating method, a blade coating method, a roller coating method, an air-knife coating method, a curtain coating method, and the like. It is also possible to use other known coating methods.

<<Image Formation Apparatus>>

As shown in FIG. 1, the image formation apparatus is configured so as to be equipped with an electrophotographic photoreceptor 1, a charging device 2, an exposing device 3, and a developing device 4. The apparatus is further equipped with a transfer device 5, a cleaning device 6, and a fixing device 7 according to need.

The electrophotographic photoreceptor 1 is not particularly limited so long as it is the electrophotographic photoreceptor of the invention described above. FIG. 1 shows, as an example thereof, a drum-shaped photoreceptor obtained by forming the aforementioned photosensitive layer on the surface of a cylindrical conductive support. The charging device 2, exposing device 3, developing device 4, transfer device 5, and cleaning device 6 have been disposed along the outer peripheral surface of this electrophotographic photoreceptor 1.

The charging device 2 is a device for charging the electrophotographic photoreceptor 1, and evenly charges the surface of the electrophotographic photoreceptor 1 to a given potential. In FIG. 1, as an example of the charging device 2, a roller type charging device (charging roller) is shown but, besides, frequently used as the charging device is a corona charging device such as a corotron or a scorotron, a contact type charging device such as a charging brush, or the like.

Incidentally, the electrophotographic photoreceptor 1 and the charging device 2 are designed detachable from the main body of the image formation apparatus in many cases as a cartridge that equips the both (hereinafter sometimes referred to as photoreceptor cartridge). For example, in the case where the electrophotographic photoreceptor 1 or charging device 2 is deteriorated, it is devised that the photoreceptor cartridge can be detached from the main body of the image formation apparatus and other new photoreceptor cartridge can be mounted on the main body of the image formation apparatus.

Moreover, the toner to be mentioned below is also designed in many cases so as to be stored in a toner cartridge and to be detachable from the main body of the image formation apparatus and, in the case where the toner in the toner cartridge is consumed, it is devised that the toner cartridge can be detached from the main body of the image formation apparatus and other new photoreceptor cartridge can be mounted thereon. Furthermore, it is also possible to use a cartridge comprising all of the electrophotographic photoreceptor 1, the charging device 2, and the toner.

The exposing device 3 is not particularly limited in the kind thereof so long as the exposing device is capable of exposing the electrophotographic photoreceptor 1 to light to form an electrostatic latent image in the photosensitive surface of the electrophotographic photoreceptor 1. Specific examples thereof include halogen lamps, fluorescent lamps, lasers such as semiconductor lasers and He—Ne lasers, LEDs, and the like.

It is also possible to conduct exposure by the technique of internal photoreceptor exposure. Any desired light may be used for exposure. For example, monochromatic light having a wavelength of 780 nm, monochromatic light having a slightly short wavelength of 600 nm to 700 nm, monochromatic light having a short wavelength of 380 nm to 500 nm, or the like may be used to conduct exposure.

The developing device 4 is not particularly limited in the kind thereof, and there can be used any desired device of a dry development technique such as cascade development, development with a one-component conductive toner, or two-component magnetic-brush development, a wet development technique, or the like. In FIG. 1, the developing device 4 includes a developing vessel 41, agitators 42, a feed roller 43, a developing roller 44, and a control member 45, and has been configured so that a toner T is retained in the developing vessel 41. According to need, a replenisher (not shown) for replenishing with the toner T may be provided to the developing device 4. This replenisher is configured so that it can be replenished with the toner T form a vessel such as a bottle or a cartridge.

The transfer device 5 is not particularly limited in the kind thereof, and there can be used a device operated by any desired technique, for example, an electrostatic transfer technique, a pressure transfer technique, an adhesive transfer technique, and the like, such as corona transfer, roller transfer, and belt transfer. Here, the transfer device 5 is a device composed of a transfer charger, a transfer roller, a transfer belt, and the like disposed so as to face the electrophotographic photoreceptor 1. A given voltage (transfer voltage) which has the polarity opposite to that of the charge potential of the toner T is applied to the transfer device 5, and this transfer device 5 thus serves to transfer the toner image formed on the electrophotographic photoreceptor 1 to recording paper (paper or medium) P.

There are no particular limitations on the cleaning device 6, and any desired cleaning device can be used, such as a brush cleaner, a magnetic brush cleaner, an electrostatic brush cleaner, a magnetic roller cleaner, or a blade cleaner but, in the invention, the effect is prone to be exhibited in the case of the blade cleaner. The cleaning device 6 serves to scrape off the residual toner adherent to the photoreceptor 1 with a cleaning member and thus recover the residual toner.

The fixing device 7 is configured of an upper fixing member (fixing roller) 71 and a lower fixing member (fixing roller) 72, and a heater 73 has been provided to the inside of the fixing member 71 or 72. FIG. 1 shows an example in which a heater 73 has been provided to the inside of the upper fixing member 71. As each of the upper and lower fixing members 71 and 72, there can be used a known thermal fixing member such as a fixing roll obtained by coating a pipe of a metal such as stainless steel or aluminum with a silicone rubber, a fixing roll obtained by further coating with a Teflon (registered trademark) resin, or a fixing sheet. Furthermore, the fixing members 71 and 72 each may be configured so that a release agent such as a silicone oil is supplied thereto in order to improve the releasability, or may be configured so that the fixing members are forcedly pressed against each other with springs or the like.

The toner transferred to the recording paper P passes through the nip between the upper fixing member 71 heated at a given temperature and the lower fixing member 72, during which the toner is heated until the toner comes into a molten state. After the passing, the toner is cooled and fixed onto the recording paper P. The fixing device also is not particularly limited in the kind thereof, and it is possible to dispose, besides the device used here, a fixing device operated in any desired mode, such as hot-roller fixing, flash fixing, oven fixing, or pressure fixing.

In the electrophotographic apparatus having the configuration described above, image recording is conducted in the following manner. Namely, first, the surface (photosensitive surface) of the photoreceptor 1 is charged to a given potential (e.g., −600 V) by the charging device 2. On this occasion, the charging may be conducted with a direct-current voltage or with a direct-current voltage on which an alternating-current voltage has been superimposed.

Subsequently, the charged photosensitive surface of the photoreceptor 1 is exposed to light by the exposing device 3 according to the image to be recorded. Thus, an electrostatic latent image is formed on the photosensitive surface. This electrostatic latent image formed on the photosensitive surface of the photoreceptor 1 is developed by the developing device 4.

In the developing device 4, the toner T fed by the feed roller 43 is spread into a thin layer with the control member (developing blade) 45 and, simultaneously therewith, frictionally charged so as to have given polarity (here, the toner is charged so as to have negative polarity, which is the same as the polarity of the charge potential of the photoreceptor 1). The toner T is conveyed while being held by the developing roller 44 and is brought into contact with the surface of the photoreceptor 1.

When the charged toner T held on the developing roller 44 comes into contact with the surface of the photoreceptor 1, a toner image corresponding to the electrostatic latent image is formed on the photosensitive surface of the photoreceptor 1. This toner image is transferred to recording paper P by the transfer device 5. Thereafter, the toner which has not been transferred and remains on the photosensitive surface of the photoreceptor 1 is removed by the cleaning device 6.

After the transfer of the toner image to the recording paper P, the recording paper P is allowed to pass through the fixing device 7 to thermally fix the toner image to the recording paper P. Thereby, a finished image is obtained.

Incidentally, the image formation apparatus may be configured so that an erase step, for example, can be conducted, besides the configuration described above. The erase step is a step in which the electrophotographic photoreceptor is exposure to light to thereby remove the residual charges from the electrophotographic photoreceptor. As an eraser, a fluorescent lamp, LED, or the like may be used. The light to be used in the erase step, in many cases, is light having such an intensity that the exposure energy thereof is at least 3 times that of the exposure light.

Moreover, the configuration of the image formation apparatus may be further modified. For example, the apparatus may be configured so that steps such as a pre-exposure step and an auxiliary charging step can be conducted therein, or may be configured so that offset printing is conducted therein. Furthermore, the apparatus may have a full-color tandem configuration in which a plurality of toners are used.

The present invention will be described in greater detail below with reference to specific Examples. However, the invention should not be construed as being limited to the following Examples. In Examples, the "parts" indicates "parts by mass".

EXAMPLES

Production of Coating Liquid for Charge Transport Layer Formation

[Coating Liquid T1]

Silicon oxide (manufactured by Nippon Aerosil Co., Ltd., product name: R9200) surface-treated with dimethyldichlorosilane and having an average primary particle diameter of 12 nm was subjected to ultrasonic dispersion in a tetrahydrofuran solvent for 3 hours to obtain a silicon oxide slurry. On the other hand, there was prepared a solution obtained by dissolving a bisphenol Z type polycarbonate resin (Mv: 40,000), a charge transport substance (1) having the following structure, an antioxidant (manufactured by BASF, product name: Irg1076), and a silicone oil (manufactured by Shin-Etsu silicone Co., Ltd., product name: KF-96) in a tetrahydrofuran solvent under heating. At room temperature, the solution was mixed with the silicon oxide slurry in a state that the slurry was not liquid-liquid separated in a still standing state, finally manufacturing a coating liquid for charge transport layer formation having a mass ratio of binder resin/charge transport substance/silicon oxide/antioxidant/silicone oil of 100/50/10/4/0.05 and a solid concentration of 18% by mass. Incidentally, the coating liquid was visually checked on its homogeneity state and was stored on still standing in a tightly sealed state.

[Chem 36]

Charge Transport Substance (1)

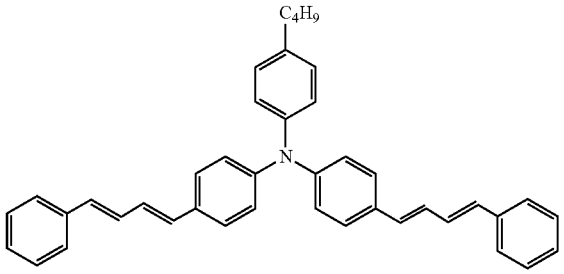

[Coating Liquids T2 to T6]

Coating liquids for charge transport layer formation (coating liquids T2 to T6) were obtained in the same manner as in the case of the coating liquid T1 using each of the charge transport substances (2) to (6) instead of the charge transport substance (1) used in the production of the coating liquid T1.

[Chem 37]

Charge Transport Substance (2): used for coating liquid T2

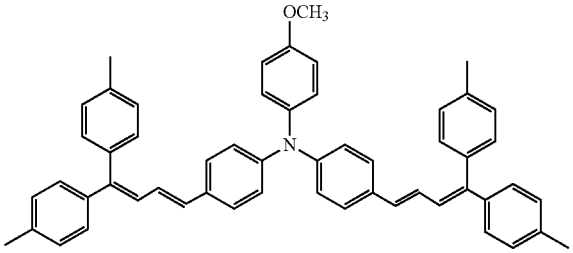

Charge Transport Substance (3): used for coating liquid T3

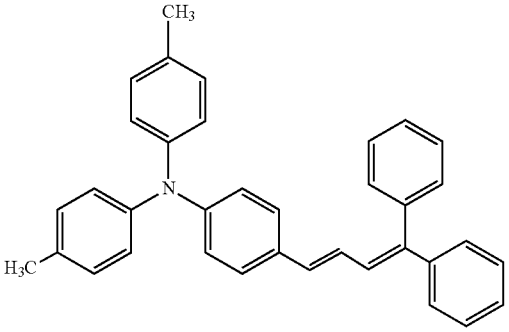

[Chem 38]

Charge Transport Substance (4): used for coating liquid T4

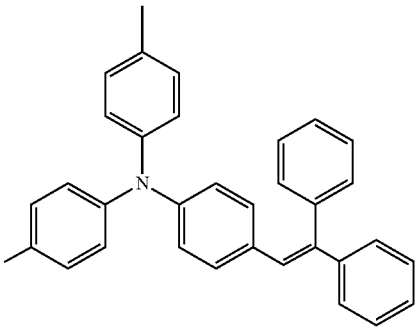

Charge Transport Substance (5): used for coating liquid T5

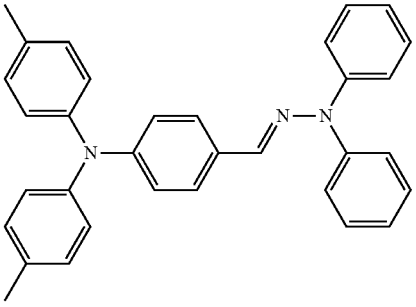

-continued

[Chem 39]

Charge Transport Substance (6): used for coating liquid T6

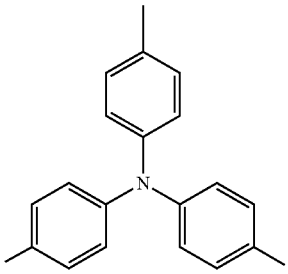

[Coating Liquid U1]

A coating liquid U1 was manufactured in the same manner as in the manufacture of the coating liquid T1 except that aluminum oxide (manufactured by Nippon Aerosil Co., Ltd., aluminum oxide C) having an average primary particle diameter of 0.02 μm was used instead of the silicon oxide used in the case of the coating liquid T1.

[Coating Liquids S1, S4, and S5]

Coating liquids S1, S4, and S5 were manufactured in the same manner as in the manufacture of the coating liquids T1, T4, and T5 except that silicon oxide (manufactured by Nippon Shokubai Co., Ltd., product name: KE-S100 was surface-treated) surface-treated with hexamethyldisilazane and having an average primary particle diameter of 0.8 μm was used instead of the silicon oxide used in the case of the coating liquids T1, T4, and T5.

[Coating Liquid W1]

Coating liquid V1 and V5 were manufactured in the same manner as in the manufacture of the coating liquids T1 and T5 except that silicon oxide (manufactured by Nippon Shokubai Co., Ltd., product name: KE-S30 was surface-treated) surface-treated with hexamethyldisilazane and having an average primary particle diameter of 0.3 μm was used instead of the silicon oxide used in the case of the coating liquid T1 and a polycarbonate resin (Mv: 40,000) having the following structure was used instead of the bisphenol Z type polycarbonate resin (Mv: 40,000) so that the molar ratio of binder resin/charge transport substance/silicon oxide/antioxidant/silicone oil became 100/40/10/4/0.05.

[Chem 40]

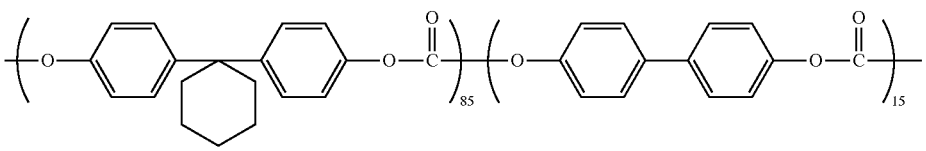

[Coating Liquid W7]

A coating liquid W7 was manufactured in the same manner as in the manufacture of the coating liquid W1 except that the charge transport substance (7) was used instead of the charge transport substance (1) used in the case of the coating liquid W1.

[Chem 41]

Charge Transport Substance (7)

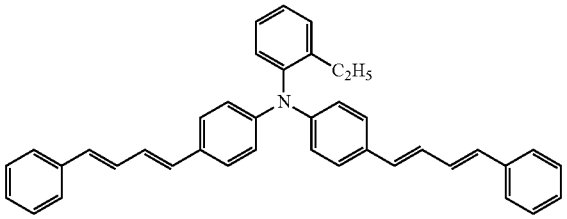

[Coating Liquid W5]

A coating liquid W5 was manufactured in the same manner as in the manufacture of the coating liquid W1 except that the charge transport substance (5) was used instead of the charge transport substance (1) used in the case of the coating liquid W1.

[Coating Liquid X8]

Silicon oxide ((manufactured by Nippon Shokubai Co., Ltd., product name: KE-S30 was surface-treated) surface-treated with dimethyldichlorosilane and having an average primary particle diameter of 0.3 μm was subjected to ultrasonic dispersion in a tetrahydrofuran solvent for 3 hours to obtain a silicon oxide slurry. On the other hand, there was prepared a solution obtained by dissolving a polyarylate resin (Mv: 40,000) having the following structure, a charge transport substance (8) having the following structure, an antioxidant (manufactured by BASF, product name: Irg1076), a silicone oil (manufactured by Shin-Etsu Silicone Co., Ltd., product name: KF-96) in a tetrahydrofuran/anisole (weight ratio 90/10) solvent under heating. At room temperature, the solution was mixed with the silicon oxide slurry in a state that the slurry was not liquid-liquid separated in a still standing state, finally manufacturing a coating liquid for charge transport layer formation having a mass ratio of binder resin/charge transport substance/silicon oxide/antioxidant/silicone oil of 100/55/10/4/0.05 and a solid concentration of 18% by mass.

[Chem 42]

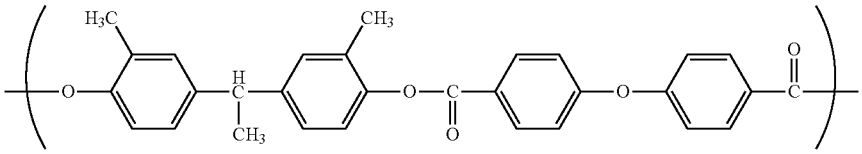

Charge Transport Substance (8)

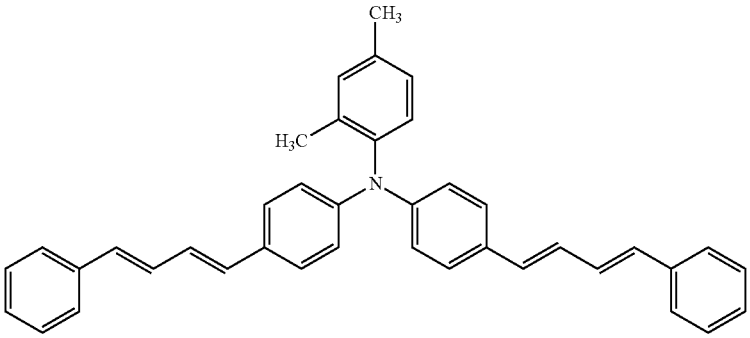

<Stability Test of Coating Liquid>

Each coating liquid after storage on still standing for 10 days from the production of the coating liquid was visually checked and its transmittance was measured. At the transmittance measurement, each coating liquid stored under tightly sealed in a still standing state at normal temperature was sampled from a position (upper face) at three fourth the liquid height in the storage vessel of the coating liquid and from a bottom position of the storage vessel of the coating liquid, and transmittance of each sample was measured. Incidentally, the transmittance measurement was performed on a Shimadzu double-beam type visible ultraviolet spectrophotometer (UV-1650PC) at a light path length of 10 mm using a commercially available special grade THF in a reference-side cell, a coating liquid sample to be measured being placed in a sample-side cell. Results are shown in Table 1.

TABLE 1

| | Coating liquid | Particles | Charge transport substance | Transmittance at upper face of coating liquid (%) | Transmittance at bottom face of coating liquid (%) | Difference in transmittance |
|---|---|---|---|---|---|---|
| Example 1 | T1 | R9200 | 1 | 94.7 | 94.6 | 0.1 |
| Example 2 | S1 | KE-S100 | 1 | 85.7 | 77.1 | 8.6 |
| Example 3 | W1 | KE-S30 | 1 | 90.3 | 90.1 | 0.2 |
| Example 4 | W7 | KE-S30 | 7 | 89.9 | 91.8 | 1.9 |
| Example 5 | X8 | KE-S30 | 8 | 90.3 | 90.3 | 0.0 |
| Comparative Example 1 | T2 | R9200 | 2 | 100.7 | 86.3 | 14.4 |
| Comparative Example 2 | T3 | R9200 | 3 | 100.7 | 80.4 | 20.3 |
| Comparative Example 3 | T4 | R9200 | 4 | 100.9 | 82.1 | 18.8 |
| Comparative Example 4 | S4 | KE-S100 | 4 | 76 | 55.1 | 20.9 |
| Comparative Example 5 | T5 | R9200 | 5 | 97.9 | 76.8 | 21.1 |
| Comparative Example 6 | S5 | KE-S100 | 5 | 69.2 | 59.1 | 10.1 |
| Comparative Example 7 | T6 | R9200 | 6 | 100.4 | 70.6 | 29.8 |
| Comparative Example 8 | U1 | Aluminum oxide C | 1 | 18.5 | 0.3 | 18.2 |
| Comparative Example 9 | W5 | KE-S30 | 5 | 84.6 | 84.2 | 0.4* |

*An interface was observed between the uppermost face of the coating liquid and the position of three fourth the liquid height.

The coating liquids falling within the range of the invention are visually homogeneous but, on the other hand, the coating liquids falling without the range of the invention are visually observed to be heterogeneous probably resulting from precipitation of silica particles. Moreover, on Comparative Example 9, an interface was observed in the liquid and the homogeneous state of the coating liquid was clearly canceled. For the other results, it is considered that more homogeneous dispersion is achieved as the difference in the transmittance between the upper face and the bottom of the coating liquid decreases, and the above measurement results support the results obtained visually.

From the above table, it was found that the coating liquids for electrophotographic photoreceptor production included in the invention are good in dispersion stability of the liquids and precipitation of inorganic particles is less prone to occur. Therefore, it was found that the coating liquids of the invention have merits in productivity since labor and time for homogenization and labor and time for checking homogeneity can be reduced.

<Homogeneity of Coated Film>

For each of the coating liquids used in Table 1, a coating liquid sampled from the upper face of the coating liquid or the bottom of the coating liquid was applied on a glass plate using a bar coater and, after air drying, drying under heating at 125° C. was performed to manufacture a coated film so that the film thickness became 18 μm. The surface of the coated film was observed on a microscope. When results on eight viewing fields each having a size of 60 μm×80 μm were summarized, results shown in Table 2 were obtained. Incidentally, the film manufactured using the coating liquid sampled from the upper face of the coating liquid was designated as Film A and the film manufactured using the coating liquid sampled from the bottom of the coating liquid was designated as Film B.

TABLE 2

| | State of films | | | | | |
|---|---|---|---|---|---|---|
| | | | | | Average number of massive materials of 4 μm or more | |
| | Coating liquid | Charge transport substance | Results of microscopic observation of coated film | Results of visual observation of appearance | Coated film A | Coated film B |
| Example 1 | T1 | 1 | No massive material is observed at both of coated films A and B and they are homogeneous. | No problem | 10 | 8 |
| Example 2 | S1 | 1 | No massive material is observed at both of coated films A and B and they are homogeneous. | No problem | 0 | 0 |
| Example 3 | W1 | 1 | No massive material is observed at both of coated films A and B and they are homogeneous. | No problem | 1 | 1 |
| Example 4 | W7 | 7 | No massive material is observed at both of coated films A and B and they are homogeneous. | No problem | 1 | 0 |
| Example 5 | X8 | 8 | No massive material is observed at both of coated films A and B and they are homogeneous. | No problem | 1 | 1 |
| Comparative Example 1 | T2 | 2 | Massive materials are observed at coated films A and B. Large massive materials are observed at coated film B as compared with coated film A and the number of the massive materials is also clearly larger at coated film B than at coated film A. | Occurrence of unevenness and whitening at coated film B | 0 | 14 |
| Comparative Example 2 | T3 | 3 | Massive materials are observed at coated films A and B. Large massive materials are observed at coated film B as compared with coated film A and the number of the massive materials is also clearly larger at coated film B than at coated film A. | Occurrence of unevenness and whitening at coated film B | 0 | 17 |
| Comparative Example 3 | T4 | 4 | Massive materials are observed at coated films A and B. Large massive materials are observed at coated film B as compared with coated film A and the number of the massive materials is also clearly larger at coated film B than at coated film A. | Occurrence of unevenness and whitening at coated film B | 2 | 24 |
| Comparative Example 4 | S4 | 4 | No massive material is observed at both of coated films A and B and they are homogeneous. | Occurrence of unevenness at coated film B | 0 | 0 |
| Comparative Example 5 | T5 | 5 | Massive materials are observed at coated films A and B. Large massive materials are observed at coated film B as compared with coated film A and the number of the massive materials is also clearly larger at coated film B than at coated film A. | Occurrence of unevenness and whitening at coated film B | 6 | 39 |
| Comparative Example 6 | S5 | 5 | No massive material is observed at both of coated films A and B and they are homogeneous. | Occurrence of unevenness at coated film B | 0 | 0 |
| Comparative Example 7 | T6 | 6 | Massive materials are observed at coated films A and B. Large massive materials are observed at coated film B as compared with coated film A and the number of the massive materials is also clearly larger at coated film B than at coated film A. | Occurrence of unevenness and whitening at coated film B | 0 | 16 |
| Comparative Example 8 | U1 | 1 | No particle is observed at coated film A but presence of many particles can be confirmed at coated film B. Thus, clear difference in film quality is observed. | Occurrence of unevenness at coated film B | 0 | 0 |
| Comparative Example 9 | W5 | 5 | No massive material is observed at both of coated films A and B and they are homogeneous. | Occurrence of unevenness at coated film B | 0 | 0 |

From the above observation results, it was found that, in the case of using a coating liquid composed of a combination of modified silica particles and a specific charge transport substance, a homogeneous coated film can be formed as a coated film composed of a coating liquid derived from the upper face of the coating liquid or the bottom of the coating liquid without any special homogenization operation of the coating liquid. On the other hand, in Comparative Examples, coated films different in film state are formed when a homogenization operation was not performed before use and there is a risk that a problem in product quality may arise. From the results, it was found that the coating liquids of Examples enable shortening of a lead time at production of products since the homogenization operation before use is not necessary and thus have a merit in productivity.

<Evaluation of Electrical Properties>

For each of the manufactured coating liquids, an electrophotographic photoreceptor was first manufactured by the following technique for evaluating electrical properties thereof.

Figure 2:
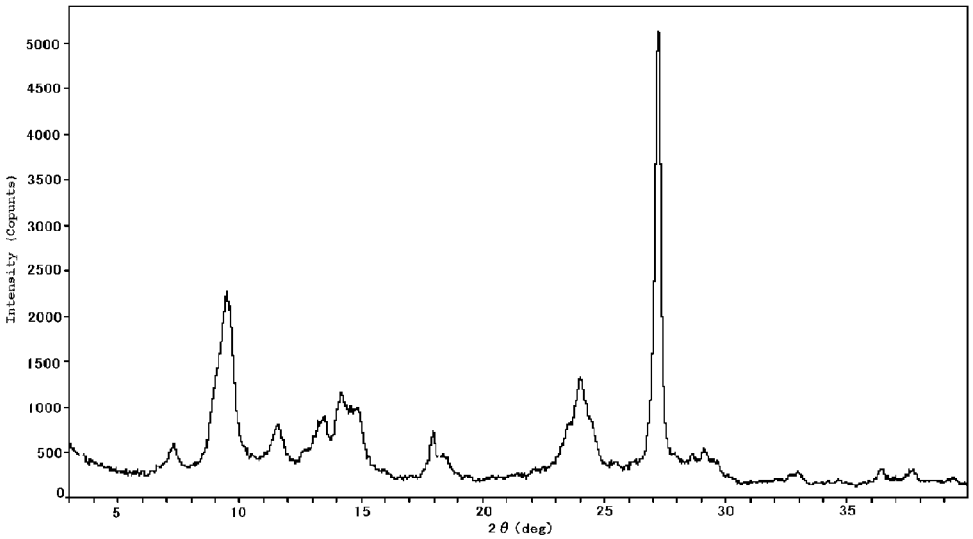
FIG. 2 is a drawing illustrating an X-ray diffraction spectrum of the oxytitanium phthalocyanine used in Examples with a CuKα characteristic X-ray.

Ten parts of an oxytitanium phthalocyanine (FIG. 2) showing a characteristic peak at the Bragg angle (2θ±0.2°) of 27.3° in a powdery X-ray spectral pattern with CuKα ray, 5 parts of poly(vinyl butyral) (manufactured by Denki Kagaku Kogyo Co., Ltd., commercial name #6000C), and 500 parts of 1,2-dimethoxyethane were mixed and subjected to a pulverization and dispersion treatment in a sand grind mill, thereby manufacturing a coating liquid for charge generation layer formation.

Next, the above-manufactured coating liquid for charge generation layer was applied on an aluminum-deposited surface of a film on which aluminum having a thickness of 75 μm had been vapor-deposited so that film thickness after drying became 0.4 μm, thereby forming a charge generation layer. On the charge generation layer, the coating liquid T1 was applied so that film thickness after drying became 19 μm, thereby forming a charge transport layer.

The above operations were conducted for the coating liquids T1, S1, T4, S4, T5, and S5, and, for each obtained photoreceptor, it was mounted on an electrophotographic characteristics evaluation device manufactured according to the standards in Society of Electrophotography of Japan (described in Basis and Application of Electrophotography Technique Continued, edited by Society of Electrophotography of Japan, published by Corona Publishing, pp. 404-405), and evaluated for the electrical properties thereof according to the following procedures through a cycle of charging (minus polarity), exposure, potential measurement and discharging under environments of 25° C./50%. The photoreceptor was so charged that the initial surface potential thereof became −700 V, and irradiated with a monochromatic light of 780 nm generated from a halogen lamp via an interference filter. Light exposure required for decreasing the initial surface potential to one half (E1/2: a unit of 0/cm$^2$) and surface potential (VL: a unit of −V) of the photoreceptor after 100 ms was measured when the exposure light was applied at an intensity of 1.0 μJ/cm$^2$ were measured. Measurement data are shown in Table 3.

TABLE 3

Electrical properties of coating liquid

| | Coating liquid | Charge transport substance | E½ (μJ/cm$^2$) | VL (V) |
|---|---|---|---|---|
| Example 1 | T1 | 1 | 0.114 | 36 |
| Example 2 | S1 | 1 | 0.118 | 53 |
| Comparative Example 3 | T4 | 4 | 0.119 | 116 |
| Comparative Example 4 | S4 | 4 | 0.13 | 144 |
| Comparative Example 5 | T5 | 5 | 0.116 | 50 |
| Comparative Example 6 | S5 | 5 | 0.122 | 59 |

From the results shown in Table 3, it was found that the coating liquids of the invention have no problem in basic performance as electrophotographic photoreceptors. Moreover, with regard to the electrophotographic photoreceptors produced using the coating liquids of the invention, it was found that, at the production thereof, a load required for homogenization of the coating liquids at production is small owing to good stability of the coating liquids and thus photoreceptors affording less filming and image defect are obtained since they each have a homogeneous photosensitive layer. It is considered that scratches to be starting points of toner filming are difficultly generated when a homogeneous silica-mixed film is formed but scratches are prone to be generated in a region where silica is not present and thus filming occurs when the film is heterogeneous.

<Evaluation of Drum Photoreceptor>

For evaluation with a drum photoreceptor, the drum photoreceptor was first manufactured by the following procedure.

[Production of Coating Liquid for Undercoat Layer Formation]

Rutile-type titanium oxide having an average primary particle diameter of 40 nm (manufactured by Ishihara Sangyo Kaisha, Ltd. "TTO55N") and 3% by mass, relative to the titanium oxide, of methyldimethoxysilane (manufactured by Toshiba Silicone "TSL8117") were mixed in a Henshel mixer and thus obtained surface-treated titanium oxide was dispersed in a mixed solvent of methanol/1-propanol having a mass ratio of 7/3 by means of a ball mill, thereby forming a dispersion slurry of the surface-treated titanium oxide.

The dispersion slurry, a mixed solvent of methanol/1-propanol/toluene, and pellets of a copolymerized polyamide in which a compositional molar ratio of ε-caprolactam [a compound represented by the following formula (A)]/bis(4-amino-3-methylcyclohexyl)methane [a compound represented by the following formula (B)]/hexamethylenediamine [a compound represented by the following formula (C)]/decamethylenedicarboxylic acid [a compound represented by the following formula (D)]/octadecamethylenedicarboxylic acid [a compound represented by the following formula (E)] is 60%/15%/5%/15%/5% were stirred and mixed under heating to dissolve the polyamide pellets and then subjected to an ultrasonic dispersion treatment, thereby manufacturing a coating liquid for undercoat layer formation having a solid concentration of 18.0%, in which mass ratio of methanol/1-propanol/toluene was 7/1/2 and the coating liquid contained surface-treated titanium oxide/copolymerized polyamide in a mass ratio of 3/1.

[Chem 43]

A

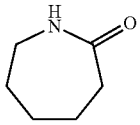

B

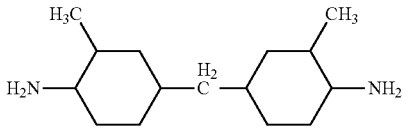

C

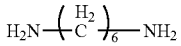

D

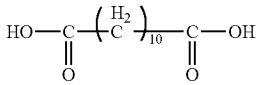

E

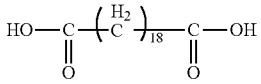

[Production of Coating Liquid for Charge Generation Layer]

Figure 3:
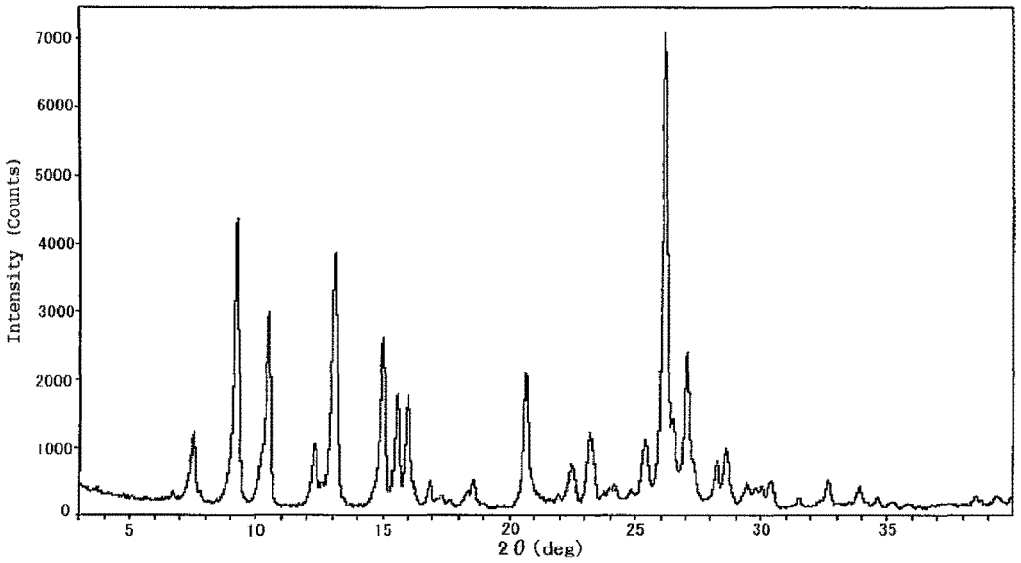
FIG. 3 is a drawing illustrating an X-ray diffraction spectrum of the oxytitanium phthalocyanine used in Examples with a CuKα characteristic X-ray.

A coating liquid was obtained by mixing 10 parts of an oxytitanium phthalocyanine (FIG. 2) showing a characteristic peak at the Bragg angle)(20±0.2° of 27.3° in a powdery X-ray spectral pattern with CuKα ray, 5 parts of poly(vinyl butyral) (manufactured by Denki Kagaku Kogyo Co., Ltd., commercial name #6000C), and 500 parts of 1,2-dimethoxyethane and subjecting the resulting mixture to a pulverization and dispersion treatment in a sand grind mill. Also, a coating liquid was obtained by mixing 10 parts of an oxytitanium phthalocyanine (FIG. 3) showing strong peaks at the Brag angles (2θ±0.2°) of 9.3° and 26.3° in a powdery X-ray spectral pattern with CuKα ray, 5 parts of poly(vinyl butyral) (manufactured by Denki Kagaku Kogyo Co., Ltd., commercial name #6000C), and 500 parts of 1,2-dimethoxyethane and subjecting the resulting mixture to a pulverization and dispersion treatment in a sand grind mill. A coating liquid in which the former coating liquid and the latter coating liquid were mixed in a ratio of 95 parts to 5 parts was manufactured and was used as a coating liquid for charge generation layer formation of a drum photoreceptor.

[Manufacture of Drum Photoreceptor]

The above-manufactured coating liquid for undercoat layer formation was applied on an aluminium cylinder having a diameter of 30 mm, a length of 285 mm, and a thickness of 0.8 mm to form an undercoat layer so that film thickness after drying became 2.7 μm. Next, the above-manufactured coating liquid for charge generation layer was applied on the undercoat layer to form a charge generation layer so that film thickness after drying became 0.4 μm. On the charge generation layer, the coating liquid for charge transport layer T1 or T5 was applied. Incidentally, the application was carried out while application conditions were determined so that the thickness of each charge transport layer became 13 μm when drying at 125° C. was performed for 20 minutes after air drying.

<Evaluation of Change in Film Thickness of Drum Photoreceptor>

For each above-manufactured drum, film thickness was measured at every 10 mm starting from the position of 50 mm from the upper end of the drum. The film thickness was measured at 3 points having a phase difference of 120° (0°, 120°, and) 240° in a circumferential direction and an average value of values obtained at the 3 points was adopted. For grasping a changing trend of the film thickness, an absolute value of a difference in film thickness between a position of n (n represents an integer)×10 mm and a position of (n+1)×10 mm was obtained at 19 points of 5≤n≤23, and the average value of the integral numerical values was compared as a numerical value that indicates the changing trend of film thickness. In the case where film thickness change is large, for example, in the case where frequency of unevenness is high, since it is considered that the integral numerical value becomes large, the value becomes an index that indicates smoothness of a film. Results are shown in Table 4.

TABLE 4

| | Coating liquid | Charge transport substance | Average integral value (μm) |
|---|---|---|---|
| Example 6 | T1 | 1 | 1.6 |
| Comparative Example 10 | T5 | 5 | 2 |

From the results shown in Table 4, it was found that the coated film of the drum of the Example is smoother.

While the invention has been described in detail and with reference to specific examples thereof, it will be apparent to one skilled in the art that various changes and modifications can be made therein without departing from the spirit and scope of the invention. The present application is based on Japanese Patent Application No. 2014-122519 filed on Jun. 13, 2014, and the contents are incorporated herein by reference.

The invention claimed is:

1. An electrophotographic photoreceptor comprising a conductive substrate, and a charge transport layer and a charge generation layer both on the conductive substrate, wherein the charge transport layer comprises a charge transport substance represented by the general formula (1), a binder resin, and a particulate silicon compound:

General Formula (1)

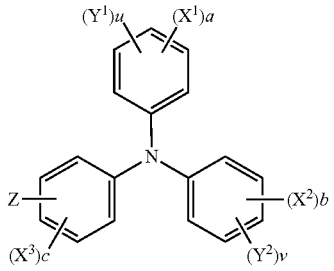

wherein $X^1$ to $X^3$ each independently represent an alkyl group, an alkoxy group, an aryl group, or an aryloxy group and a to c each independently represent 0 to 5; $Y^1$ and $Y^2$ each independently represent an alkenyl structure represented by the following general formula (A) and u and v each independently represent 0 to 3; z represents an alkenyl structure represented by the following general formula (B):

General Formula (A)

$$-(CR^1{=}CR^2)_m-CR^3{=}CR^4R^5$$

wherein $R^1$ to $R^4$ each independently represent a hydrogen atom, an alkyl group, or an aryl group, $R^5$ represents an aryl group, and m represents 0 to 3;

—HC=HC—CH=CH—$Ar^1$ General Formula (B)

wherein $Ar^1$ represents an aryl group.

2. The electrophotographic photoreceptor according to claim 1, wherein the particulate silicon compound is subjected to a surface treatment with a reactive organosilicon compound.

3. The electrophotographic photoreceptor according to claim 1, wherein the content of the particulate silicon compound is 5% by mass or more and 15% by mass or less in the solid content in the charge transport layer.

4. The electrophotographic photoreceptor according to claim 1, wherein an average primary particle diameter of the particulate silicon compound is 0.01 μm or more and 1.0 μm or less.

5. The electrophotographic photoreceptor according to claim 1, further comprising an ether having a boiling point of 90° C. or lower and an ether having a boiling point of 120° C. or higher.

6. The electrophotographic photoreceptor according to claim 1, wherein the charge transport substance represented by the general formula (1) is contained in an amount of 60 parts by mass or less relative to 100 parts by mass of the binder resin in the charge transport layer.

7. The electrophotographic photoreceptor according to claim 1, wherein the charge transport layer comprises a silicone oil.

8. The electrophotographic photoreceptor according to claim 1, wherein, when the photoreceptor is charged so that initial surface potential of the photoreceptor becomes −700 V, and the photoreceptor is irradiated with a monochrome light of 780 nm to irradiate it with the exposure light at an intensity of 1.0 μJ/$cm^2$, an absolute value of surface potential of the photoreceptor after 100 ms is 53 V or less.

9. The electrophotographic photoreceptor according to claim 1, wherein, in the general formula (1), a=1, b=0, c=0, v=1, and u=0, $Y^2$ and Z are substituted on a para-position starting from the carbon to which a nitrogen atom is bonded; in the general formula (A), m=1, $R^1$ to $R^4$ are each a hydrogen atom, and $R^5$ is an aryl group.

10. The electrophotographic photoreceptor according to claim 1, wherein the charge transport substance represented by the general formula (1) is a charge transport substance represented by the general formula (2):

General Formula (2)

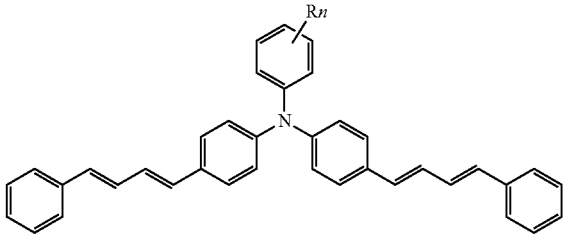

wherein R is an alkyl group or alkoxy group having 8 or less carbon atoms; n represents an integer of 0 to 3; and, when n is 2 or 3, each R independently represents an alkyl group or alkoxy group having 8 or less carbon atoms.

11. The electrophotographic photoreceptor according to claim 1, wherein the charge transport substance represented by the general formula (1) is at least one charge transport substance represented by formula selected from the group consisting of the general formulae (1A), (1B), (1C), (1D), and (1E):

(1 A)

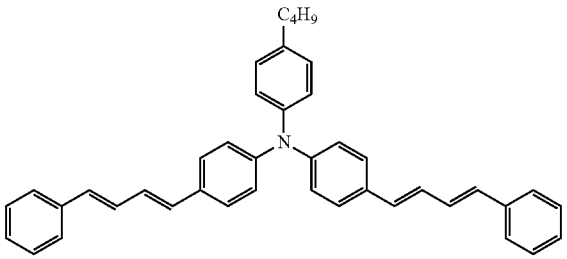

(1 B)

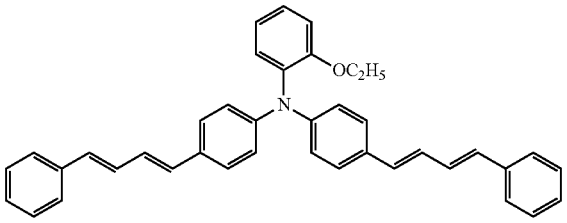

(1 C)

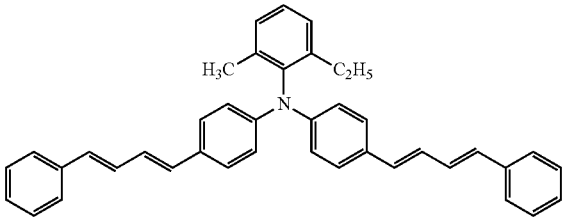

(1 D)

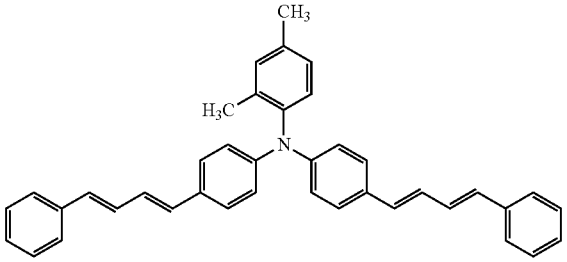

(1 E)

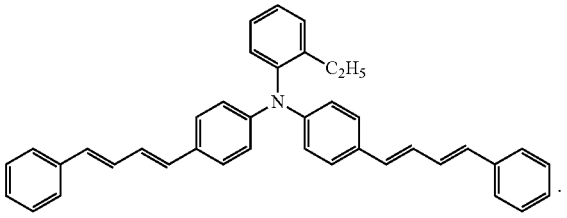

12. An electrophotographic photoreceptor cartridge comprising: the electrophotographic photoreceptor according to claim 1; and at least one device selected from the group consisting of a charging device that charges the electrophotographic photoreceptor, an exposing device that exposes the charged electrophotographic photoreceptor to form an electrostatic latent image, and a developing device that develops the electrostatic latent image formed on the electrophotographic photoreceptor.

13. An image formation apparatus comprising: the electrophotographic photoreceptor according to claim 1; and at least one device selected from the group consisting of a charging device that charges the electrophotographic photoreceptor, an exposing device that exposes the charged electrophotographic photoreceptor to form an electrostatic latent image, and a developing device that develops the electrostatic latent image formed on the electrophotographic photoreceptor.

14. The electrophotographic photoreceptor according to claim 1, wherein average primary particle diameter of the particulate silicon compound is 0.3 μm or more and 0.9 μm or less.

15. A coating liquid for electrophotographic photoreceptor production, comprising: a charge transport substance represented by the general formula (1), a binder resin, and a particulate silicon compound:

General Formula (1)

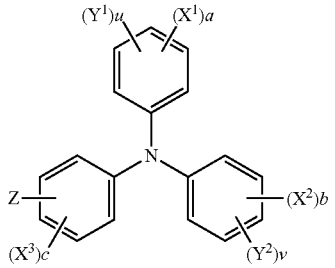

wherein $X^1$ to $X^3$ each independently represent an alkyl group, an alkoxy group, an aryl group, or an aryloxy group and a to c each independently represent 0 to 5; $Y^1$ and $Y^2$ each independently represent an alkenyl structure represented by the general formula (A) and u and v each independently represent 0 to 3; z represents an alkenyl structure represented by the general formula (B):

General Formula (A)

$$-(CR^1{=}CR^2)_m-CR^3{=}CR^4R^5$$

wherein $R^1$ to $R^4$ each independently represent a hydrogen atom, an alkyl group, or an aryl group, $R^5$ represents an aryl group, and m represents 0 to 3;

$$-HC{=}HC-CH{=}CH-Ar^1$$ General Formula (B)

wherein $Ar^1$ represents an aryl group.

16. The coating liquid for electrophotographic photoreceptor production according to claim 15, further comprising an ether having a boiling point of 90° C. or lower and an ether having a boiling point of 120° C. or higher.

17. The coating liquid for electrophotographic photoreceptor production according to claim 15, wherein, upon microscopic observation of a surface of a coated film obtained by applying the coating liquid on a conductive substrate so that the film thickness becomes 18 μm, the average number of massive materials of 4 μm or more observed in eight viewing fields each having a size of 60 μm×80 μm is 10 or less.

18. The coating liquid for electrophotographic photoreceptor production according to claim 15, wherein the charge transport substance represented by the general formula (1) is a charge transport substance represented by the general formula (2):

General Formula (2)

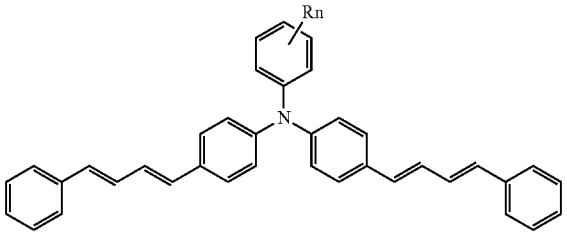

wherein R is an alkyl group or alkoxy group having 8 or less carbon atoms; n represents an integer of 0 to 3; and, when n is 2 or 3, each R independently represents an alkyl group or alkoxy group having 8 or less carbon atoms.

19. A coating liquid for electrophotographic photoreceptor production, comprising at least a charge transport substance represented by the general formula (1), a binder resin, and a particulate silicon compound:

General Formula (1)

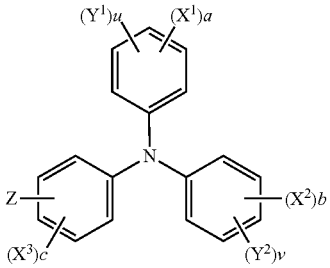

wherein $X^1$ to $X^3$ each independently represent an alkyl group, an alkoxy group, an aryl group, or an aryloxy group and a to c each independently represent 0 to 5; $Y^1$ and $Y^2$ each independently represent an alkenyl structure represented by the following general formula (A) and u and v each independently represent 0 to 3; z represents an alkenyl structure represented by the following general formula (B):

General Formula (A)

$$-(CR^1{=}CR^2)_m-CR^3{=}CR^4R^5$$

wherein $R^1$ to $R^4$ each independently represent a hydrogen atom, an alkyl group, or an aryl group, $R^5$ represents an aryl group, and m represents 0 to 3, $$-HC{=}HC-CH{=}CH-Ar^1$$ General Formula (B)

wherein $Ar^1$ represents an aryl group, wherein, after storage on still standing for 10 days from the day when the coating liquid is produced, either of first transmittance of a light having a wavelength of 780 nm through the coating liquid at a position of three fourth the liquid height in the storage vessel of the coating liquid and second transmittance of the light through the coating liquid at the bottom of the storage vessel of the coating liquid is 85% or more, and a difference between the first transmittance and the second transmittance falls within 10%.

* * * * *